US006181310B1

(12) United States Patent
Nomura

(10) Patent No.: US 6,181,310 B1
(45) Date of Patent: Jan. 30, 2001

(54) DRIVING METHOD OF LIQUID CRYSTAL APPARATUS

(75) Inventor: Hiroaki Nomura, Suwa (JP)

(73) Assignee: Seiko Epson Corporation, Tokyo (JP)

( * ) Notice: Under 35 U.S.C. 154(b), the term of this patent shall be extended for 0 days.

(21) Appl. No.: 09/051,705

(22) PCT Filed: Aug. 11, 1997

(86) PCT No.: PCT/JP97/02813

§ 371 Date: Apr. 17, 1998

§ 102(e) Date: Apr. 17, 1998

(87) PCT Pub. No.: WO98/08132

PCT Pub. Date: Feb. 26, 1998

(30) Foreign Application Priority Data

Aug. 19, 1996 (JP) ..... 8-217657

(51) Int. Cl.[7] ..... G09G 3/36
(52) U.S. Cl. ..... 345/97; 345/94; 345/103
(58) Field of Search ..... 345/103, 87, 94, 345/95, 96, 97, 99, 110, 206, 208, 209, 210

(56) References Cited

U.S. PATENT DOCUMENTS

| | | | | |
|---|---|---|---|---|
| 4,239,345 | | 12/1980 | Berreman et al. | 350/334 |
| 5,296,953 | * | 3/1994 | Kanbe et al. | 345/87 |
| 5,488,499 | | 1/1996 | Tanaka et al. | 359/102 |
| 5,594,464 | | 1/1997 | Tanaka et al. | 349/94 |
| 5,684,503 | | 11/1997 | Nomura et al. | 345/97 |

FOREIGN PATENT DOCUMENTS

| | | |
|---|---|---|
| 2-116823 | 5/1990 | (JP) . |
| 4-32383 | 2/1992 | (JP) . |
| 4-148845 | 5/1992 | (JP) . |
| 5-100642 | 4/1993 | (JP) . |
| 6/230751 | 8/1994 | (JP) . |
| 6-508451 | 9/1994 | (JP) . |
| 7-175041 | 7/1995 | (JP) . |
| 8-30283 | 2/1996 | (JP) . |
| 8-101371 | 4/1996 | (JP) . |

* cited by examiner

*Primary Examiner*—Dennis-Doon Chow
(74) *Attorney, Agent, or Firm*—Oliff & Berridge, PLC

(57) ABSTRACT

A driving method of a liquid crystal apparatus has an initial state of twisted angle Φ, a first stable state of Φ−180° and a second stable state of Φ+180° in alignment. Scanning electrodes are divided into a plurality of groups for sequential selection of the groups. Scanning signals are applied to the scanning electrodes within a group substantially simultaneously.

19 Claims, 22 Drawing Sheets

DRIVING METHOD OF LIQUID CRYSTAL APPARATUS

FIELD OF THE INVENTION

The present invention relates to a driving method of a liquid crystal apparatus, and more particularly, to a driving method of a liquid crystal having a liquid crystal provided with a memory property.

BACKGROUND OF THE INVENTION

A driving method of a liquid crystal apparatus using chiral nematic liquid crystal is disclosed in Japanese Examined Patent Publication No. 1-51,818 (corresponding to U.S. Pat. No. 4,239,345). The patent specification describes an initial orientational condition in the initial state under non-application of voltage, two metastable states, and a method for switching over between the two metastable states. However, the patent specification contains however no description about a practicable method for driving, and further, it discloses nothing about a driving method of a matrix display which is at present the most practical liquid crystal display.

Under these circumstances, the present inventors filed applications for Japanese Unexamined Patent Publication No. 6-230,751 and Japanese Unexamined Patent Publication No. 7-175,041 relating to driving methods for matrix display and achieved a practicable liquid crystal display unit and a driving method thereof. More specifically, the present inventors prepared a liquid crystal apparatus formed by holding a chiral nematic liquid crystal having an initial twist angle Φ (for example, 180°) between a pair of substrates. A stripe-shaped electrode is formed on each of the substrates. The conventional driving method is as follows.

A giant pulse sufficient to transfer the liquid crystal molecules to homeotropic state is applied to the liquid crystal layer held between the pair of substrates. Then, after a certain interval of a delay time, a selection pulse using a critical value as the reference is applied to the liquid crystal to create a 0° uniform state (Φ−180°) or a 360° (Φ+180°) twisted state after relaxation of the homeotropic state. A display is achieved by the foregoing Φ−180° state and the Φ+180° state: the former is referred to as ON state, and the latter, as OFF state. This driving method is based on the pulse response of the liquid crystal.

FIG. 7 illustrates an example of a driving waveform representing another conventional driving method. (a) of FIG. 7 is a common waveform applied to a scanning electrode, and (b) of FIG. 7 is an example of a data waveform applied to a signal electrode. The common waveform is applied to the above-mentioned scanning electrode during a prescribed period of time comprising a reset period 8, a delay period 9, a selection period 10, and a non-selection period 11.

More specifically, a giant pulse is applied during the reset period, and an interval is placed during the delay period. During the K-th line selection period 10 of matrix display, a selection pulse having an amplitude of selecting an ON-state or an OFF-state of the display is applied. During the remaining non-selection period, the other scanning electrode is selected. This conventional driving method is based on line-sequential scanning.

The giant pulse applied during the reset period 8 is a pulse having a pulse height of at least 17 V, and requires a sustaining time of about 1 to 2 ms. The selection pulse applied during the selection period 10 should preferably have a voltage three to four times as high as the data voltage applied to the signal electrode.

The delay period 9 should be a time of several hundred μs, and voltage should be null (reference voltage Vc) during the delay period and the non-selection period 11.

The data waveform (b) should show a symmetrical form of amplitude on the positive and negative sides in relation to the reference voltage Vc. When the phase of data waveform is the same as the phase of selection pulse, the display OFF-state is selected, and when it is an antiphase, the display ON-state is selected. Except for the reset period 8, therefore, the process would be based on the same method of general passive matrix addressing.

Inversion of signal for AC conversion is conducted for every interval of several times of the selection period (1H) (nH; n is a positive integer) within one frame, and a DC component is canceled by reversing the waveforms of the immediately preceding frame. The waveform, not shown here, applied to the liquid crystal media is equal to the difference between the common signal and the data signal. No problem is therefore caused if a waveform having the same level of voltage to that in this example is applied. Another example could be put into practice by dividing the voltage levels of the common signals and the data signals into two groups of low and high voltages and selecting certain voltage levels of these signals between these two groups in a hopping manner. Examples of these practices are described in the foregoing Japanese Unexamined Patent Publication.

In a liquid crystal apparatus using a super twisted nematic liquid crystal (STN liquid crystal), on the other hand, rapid attenuation of the display state not experienced in the conventional cumulative response, i.e., attenuation of transmissivity becomes larger, when the response time of liquid crystal materials are shorter, and the resultant lower contrast phenomenon is known as a frame response.

As a measure to solve this problem, a concept in which a plurality of scanning electrodes are simultaneously addressed (or scanning lines) is developed. (This is hereinafter referred to as the "multi-line driving method", and abbreviated as the "MLS driving method"). These circumstances are described in detail in the Japanese Unexamined Patent Publication No. 5-100,642 and Japanese Unexamined Patent Publication No. 4-148,845.According to these documents, in the aforesaid driving method, a plurality of selection periods are provided in a single scanning waveform, and are dispersed in a frame. In this driving method, therefore, a necessary transmissivity is determined and an ON/OFF state of display is obtained by accumulating responses of liquid crystal for individual selecting period. This driving method is utilizing cumulative response of the liquid crystal and the root mean square (RMS) response effect.

FIG. 8 shows an example of the conventional driving method: the driving waveforms for simultaneously selecting of four scanning electrodes. Common waveforms R1 to R4 applied to the four scanning electrodes are as shown in FIG. 8. That is, the selection periods S1 to S4 are dispersed within a frame, and a selection pulse is applied to the liquid crystal equally at four every period t. A property known as orthogonal normality as referred to in the aforesaid patent application is imparted between the individual common waveforms. More specifically, the selection pulse applied to the individual selection periods (S1 to S4) of the four scanning electrodes R1 to R4, by assuming 1 for the positive side and 0 for the negative side relative to a reference voltage (Vc), is expressed by a determinant. A selection voltage is set so that this determinant satisfies orthogonality.

Data waveforms C1 and C2 are shown in FIG. 8, in which examples of data signals to each four rows accessed simultaneously are illustrated. Voltage of the data signal is set at any of five voltage levels in total relative to the reference potential (Vc: i.e., zero). Specifically, a data signal is determined in response to the four selected rows and a display state of the column crossing these rows (there are $2^4$=16 ON/OFF combinations).

Applying to a practical circuit, a common signal and data signals are passed through 4 exclusive OR gates, and the level of a voltage to be applied to LCD will be fixed by counting the output states of the gates.

Thus, the voltage to be applied to the liquid crystal is as effective as a RMS voltage which is the difference between the common signals and the data signals in a frame period. Therefore, a display state in compliance with the RMS voltage is available even by a driving method using a selection period divided into four. AC conversion of the driving waveform is accomplished through inversion for every frame. AC conversion of a voltage applied to the liquid crystal layer is achieved through two frames.

By using the driving method shown in FIG. 7, the present inventors could drive a conventional liquid crystal apparatus at a duty ratio of 1/240, and succeed in driving such a large-capacity liquid crystal apparatus. In order to achieve a liquid crystal display of a larger capacity by improving a driving method, it was necessary to reduce the selection period for the writing pulse and achieve a faster response time of a liquid crystal, however this requirement inevitably led to a narrower driving voltage margin of the display element for the existing liquid crystal materials.

SUMMARY OF THE INVENTION

To solve these problems, the present invention was developed by improving the conventional MLS driving method, so as to be applicable to the liquid crystal display unit which respond to a short writing pulse with reference to those of an STN-type liquid crystal. That is, shortening the writing pulse width required for a larger capacity display is supplemented by the new MLS driving method and the timing of the applied pulse is optimized in conformance with the response property of the liquid crystal, thereby ensuring a sufficient driving voltage margin.

The main objects of the present invention are to reduce the writing pulse width along with the tendency toward a larger capacity display and to optimize the application timing of the pulse in conformance with the response property of the liquid crystal, thereby ensuring a sufficient driving margin.

In a preferred embodiment of the driving method of a liquid crystal apparatus of the invention, the method comprises a pair of opposed substrates holding a liquid crystal layer in between, wherein: the liquid crystal layer has at least an initial state in which the liquid crystal molecules have a twisted angle Φ, a first stable state in which the liquid crystal has an orientation of substantially Φ−180°, and a second stable state in which the liquid crystal has an orientation of substantially Φ+180°; the orientation of the liquid crystal layer is controlled by a scanning signal applied to a plurality of scanning electrodes formed on one of the substrates and a data signal applied to a plurality of signal electrodes formed on the other substrate; the scanning signal has at least a reset pulse applied during a reset period and a selection pulse applied during a selection period, and the data signal is applied to the signal electrodes for each selection of the scanning electrodes; and the plurality of scanning electrodes are divided into a plurality of groups, the scanning signal is applied to the scanning electrodes in the plurality of groups substantially simultaneously, and the plurality of groups are sequentially selected.

By using such a driving method, and applying a method known as the MLS driving method, it is possible to adjust the applied voltage and the application time of the selection pulse relative to the liquid crystal molecules in the transition process. It is therefore possible to derive an optimum switching property.

For example, the length of the application time can be adjusted by changing the number of scanning electrodes simultaneously selected within a range of frame frequency (50–60 Hz) inhibiting flickers generated in the liquid crystal apparatus.

There should preferably be 2n (n is an integer of at least 1) scanning electrodes in each such group, or more preferably, four scanning electrodes in a group.

A scanning signal is applied substantially simultaneously to the scanning electrodes in each group. Within an individual period, i.e., within a reset period, a reset pulse is applied substantially simultaneously to all the scanning electrodes, and in the selection period, a selection pulse is substantially simultaneously applied.

The selection pulse applied during the selection period is set on the basis of an orthogonal function. By setting the same in compliance with a Hadamard matrix, it is possible to solve problems such as threading of each scanning electrode.

The selection pulse is applied continuously during the selection period, or applied in a dispersed state during the selection period. This is an optimum driving method for selecting a first stable state and a second stable state, and appropriate timing and application time as set as required. That is, it suffices that the selection pulse is appropriately applied during a period from the start of movement of the liquid crystal molecules from the vertical orientation toward one of the two stable status to the completion of transition.

A delay period is set in conformance with the timing of the selection period. That is, a voltage can be applied to the liquid crystal layer at an optimum timing by setting the delay period between the reset period and the selection period.

On the assumption of the selection period of 1H, the delay period is set to nH (n is an integer). The driving method of the invention providing the delay period as described above brings about an advantage of inhibiting a crosstalk voltage from being applied during the delay period. Particularly, by adopting a driving method of applying selection pulse in a dispersed manner during the selection period, voltage is applied intermittently, thus inhibiting the voltage from being applied to the liquid crystal. It is therefore possible to inhibit voltage from being associated with crosstalk and thus prevent occurrence of crosstalk.

Upon selecting the first stable state and the second stable state, selection pulses applied to the scanning electrodes are set equal RMS voltages. That is, the first stable state or the second stable state is selected, depending upon the data signal.

A group may be set with a plurality of scanning electrodes arranged adjacent to each other, or a group may be set with a plurality of scanning electrodes arbitrarily selected. In any of these cases, a scanning signal is applied simultaneously to the scanning electrodes within each group.

The arbitrarily selected scanning electrodes, which compose the individual groups are selected from individual blocks.

In the invention, each group is composed of at least one virtual electrode serving as a plurality of actually existing scanning electrodes, and a scanning signal is treated as being applied to the virtual electrode simultaneously with applying the scanning signal to the plurality of scanning electrodes.

The driving method based on virtual electrodes comprises supplying a scanning signal to the scanning electrodes and being set so as to achieve agreement between data of the virtual electrodes and displayed data. By adopting the driving method, it is possible to reduce the voltage level of a data signal applied to the signal electrode.

A liquid crystal apparatus using the driving method of a liquid crystal apparatus as described above can be mounted as an electronic equipment.

DETAILED DESCRIPTION OF THE PREFERRED EMBODIMENTS (General Structure of a Liquid Crystal Cell Used for an Application of the Invention)

The liquid crystal media used in the embodiments were prepared by adding an optical activation agent to the liquid crystal. The helical pitch is adjusted by adding the optical activation agent to the liquid crystal. The twisted angle of the liquid crystal molecules is also adjusted.

A nematic liquid crystal such as ZLI-3329 made by E. Merck Company was used as a liquid crystal material. For example, a chiral agent made by E. Merck Company was used as an optical activation agent added to the liquid crystal. The helical pitch of the liquid crystal is adjusted by these materials within a range of from 3 to 4 $\mu$m.

Figure 9:
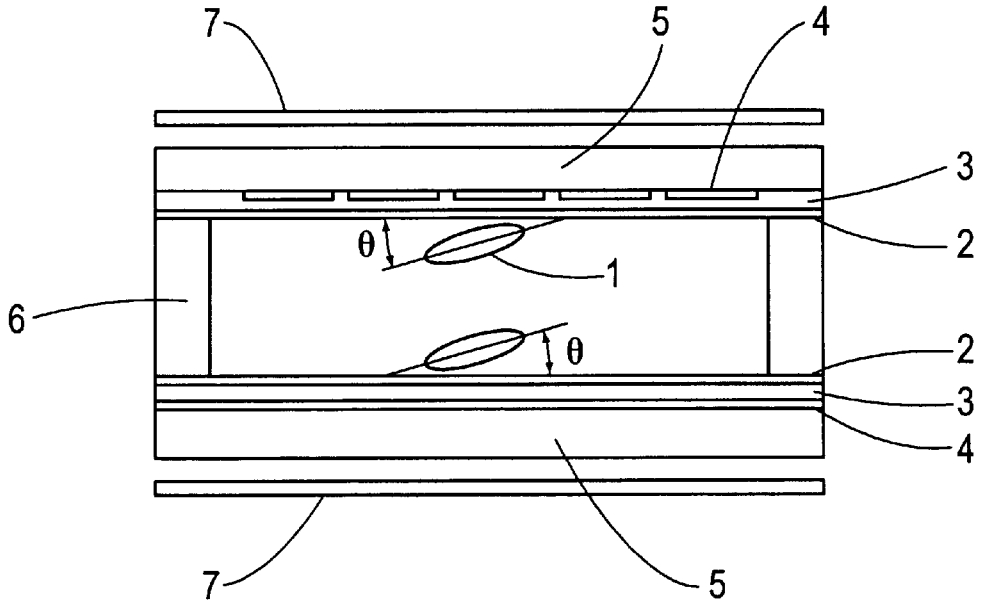
FIG. 9 illustrates a configuration of the liquid crystal apparatus used in the invention.

As shown in FIG. 9, a transparent electrode 4 comprising ITO is formed into a stripe pattern on a pair of glass substrates 5, and an alignment film 2 comprising polyimide is coated onto the substrates. A flattening layer 3 is formed on the electrode in FIG. 9, but the flattening layer 3 may be omitted.

The alignment film 2 formed on each substrate is rubbing-treated. The rubbing treatment applied to the substrate is made so as to form a prescribed angle $\Phi$ in the initial state of the liquid crystal molecules. There occurs a slight shift between an angle formed by the rubbing direction in the rubbing treatment applied to the substrate and the twisted angle of the liquid crystal molecules. In general, the twisted angle of liquid crystal molecules is smaller than the angle formed by the rubbing direction. Therefore, the angle formed by the rubbing direction is slightly larger than the twisted angle $\Phi$ of liquid crystal molecules.

As described above, the rubbing treatment is applied so that the twisted angle of liquid crystal molecule becomes $\Phi$ ($\Phi$ is assumed to be substantially 180° in this embodiment), and liquid crystal molecules 1 are oriented adjacent to the substrate so as to form a pre-tilt angle $\theta$ as shown FIG. 9.

A liquid crystal cell is prepared by bonding the pair of substrates by means of a sealing material 6. A polarization plate 7 is arranged on the liquid crystal cell to form a liquid crystal apparatus. A spacer is inserted between the glass substrates 5. This spacer is arranged as a gap material for achieving a uniform gap between the pair of substrates. It is not necessary to arrange the spacer when the substrates can be held with a uniform gap by the sealing material for bonding the pair of substrates. A spacer may be arranged in the sealing material and/or in the display area.

In the present specification, a gap (i.e., a cell gap) of up to 2 $\mu$m is set between the pair of substrates. By setting a cell gap of up to 2 $\mu$m, and at the same time, a more rapid switching between the two stable states is ensured. In the invention, setting as described above permits setting of a ratio of liquid crystal layer thickness/helical pitch within a range of 0.5±0.2.

Figure 10:
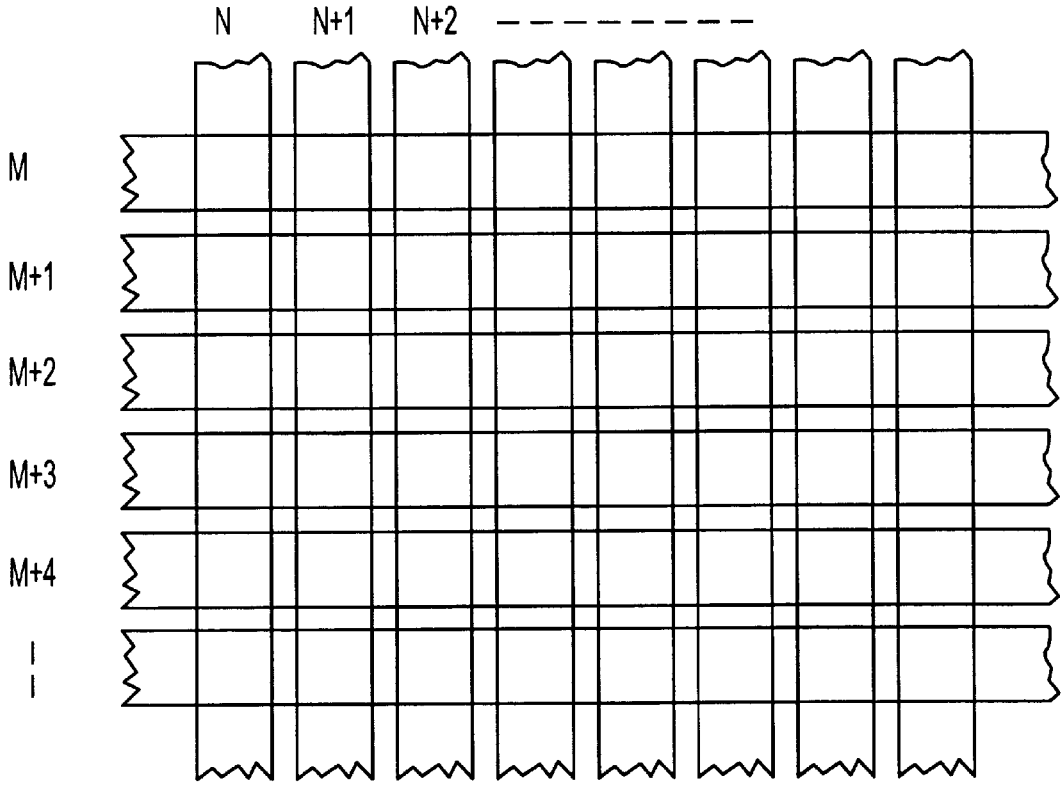
FIG. 10 illustrates an electrode configuration of the liquid crystal apparatus of the invention.

FIG. 10 illustrates the electrode portion configuration in detail regarding the configuration shown in FIG. 9. As shown in FIG. 10, voltage is appropriately applied to a stripe-patterned electrode (M) formed on one of the substrates and an electrode (N) formed on the other substrate, to perform matrix display. In this specification, the electrode (M) is defined as a scanning electrode and the electrode (N) as a signal electrode for the following description.

The electrode is formed from a material comprising, for example, such a material as ITO in the invention. When forming a reflection-type crystal liquid apparatus, however, one of the substrates may have an electrode formed from a material having reflecting property such as aluminum or chromium. A reflection-type liquid crystal apparatus can be formed also by forming a reflecting layer on the side opposite to the liquid crystal layer contacting side of one of the substrates.

(Orientation of Liquid Crystal)

Figure 17:
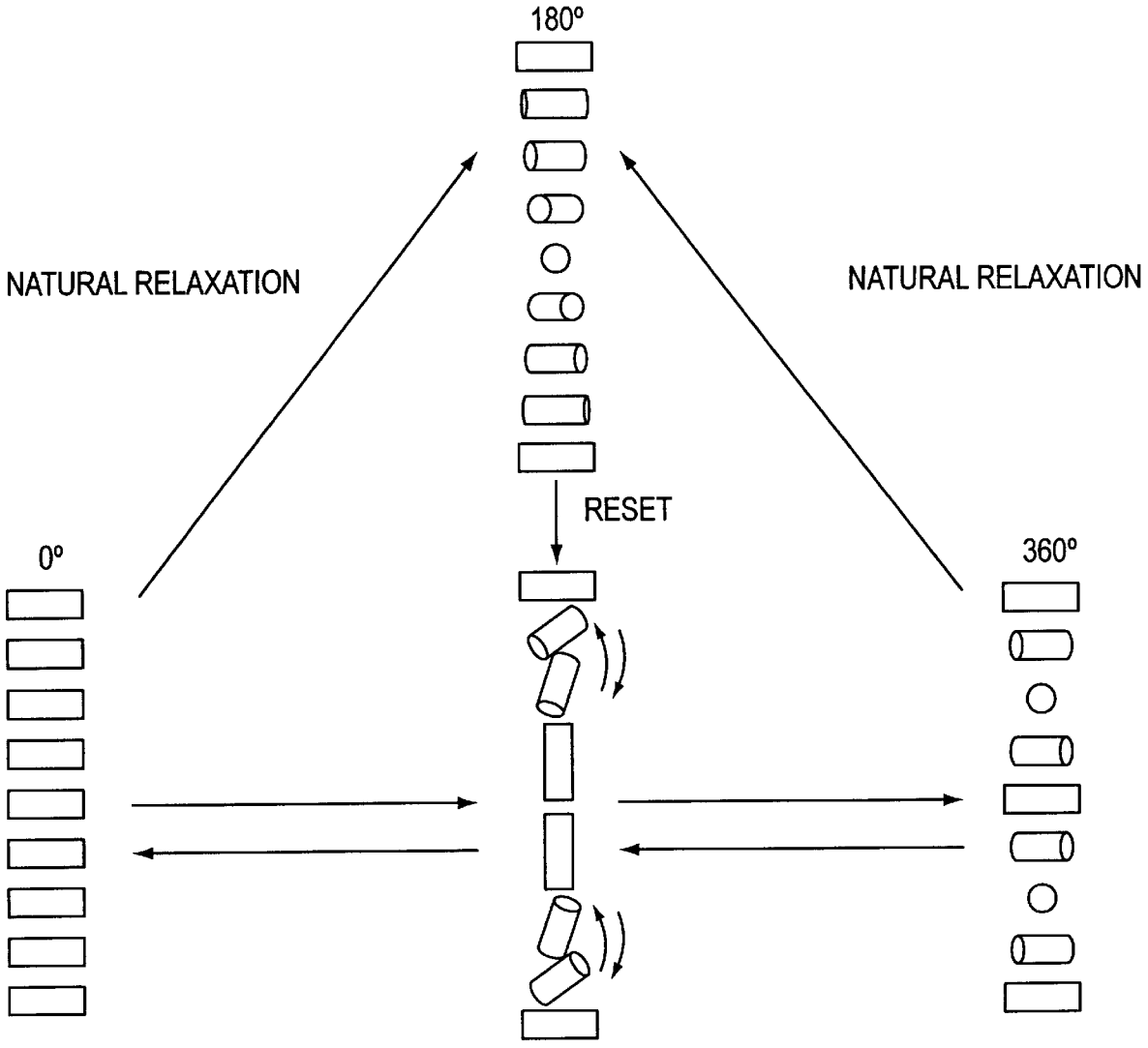
FIG. 17 illustrates an orientation of liquid crystal molecules in the liquid crystal apparatus of the invention.

Orientation of liquid crystal molecule is illustrated in FIG. 17. As shown in FIG. 17, orientation of the liquid crystal molecules in the liquid crystal apparatus in the invention takes any of the following four states: an initial state, a reset state, a first stable state, and a second stable state, as shown in FIG. 17.

The initial state is a state prior to application of voltage to the liquid crystal layer held between the pair of substrates, or a state including a twisted angle of Φ of the liquid crystal molecules. The twisted angle Φ specifically is a state in which the twisted angle of liquid crystal molecule is 180° in FIG. 17.

FIG. 17 schematically illustrates the status of orientation of liquid crystal molecules in the liquid crystal layer held between the pair of substrates. The liquid crystal molecules adjacent to the substrate should have therefore a prescribed pre-tilt angle (θ) as shown in FIG. 9. Since FIG. 17 illustrates orientation only schematically, the liquid crystal molecules are drawn in parallel.

The reset state is a state in which liquid crystal molecules in the liquid crystal cell are substantially vertically aligned to the substrate surface (see FIG. 17). As described later, the reset state occurs as a result of application of voltage during the reset period. At this period, a reset voltage of over the threshold value is applied to the scanning electrode. In other words, the reset state is a state in which Fre'ederickz transition occurs. In order to achieve the reset state of the liquid crystal media, therefore, a voltage capable of causing Fre'ederickz transition should be applied to the liquid crystal media.

It should however be noted that all the liquid crystal molecules between the pair or substrates are not necessarily almost vertically aligned. That is, liquid crystal molecules adjacent to the substrate are not always vetical to the substrate. In general, a state in which liquid crystal molecules at around the center portion between the substrates are oriented substantially vertically is referred to as the reset state in the present specification.

Now, the first stable state is available by applying a voltage during the selection period. At this period, a selection pulse is applied to the scanning electrode. The first stable state has a memory property for a prescribed period of time, and retains this state. As shown in FIG. 17, liquid crystal molecules are oriented in almost the same direction. The liquid crystal molecules here have a twisted angle of Φ−180°. More specifically, the liquid crystal molecules have a uniform orientation of substantially 0°.

There exists, on the other hand, a second stable state different from the first stable state. The second stable state as well is available by applying a voltage during the selection period. As in the first stable state, the second stable state has a memory property for a prescribed period of time. In the second stable state, the liquid crystal molecules have a twisted angle of Φ+180°, i.e., a twisted angle substantially equal to 360°.

Selection of the first stable state or the second stable state depends upon the value of voltage applied to the liquid crystal layer. The critical value serves as a reference. With the critical value as the reference, when the voltage applied to the liquid crystal layer is lower than the critical value, an angle of Φ+180° (substantially the state of 360° twisted) is selected, and when the value of voltage is higher than the reference, an angle of Φ−180° (almost null) is selected. The critical value varies with properties of the liquid crystal cell, and may itself have a certain range.

The memory property of the first stable state and the second stable state is finite, and this state of memory can be maintained only for a limited period of time. The first stable state and the second stable state are then spontaneously attenuated to the initial state, i.e., the twisted angle becomes Φ (substantially 180°).

(Typical Driving Waveforms Used in the Invention)

Figure 1:
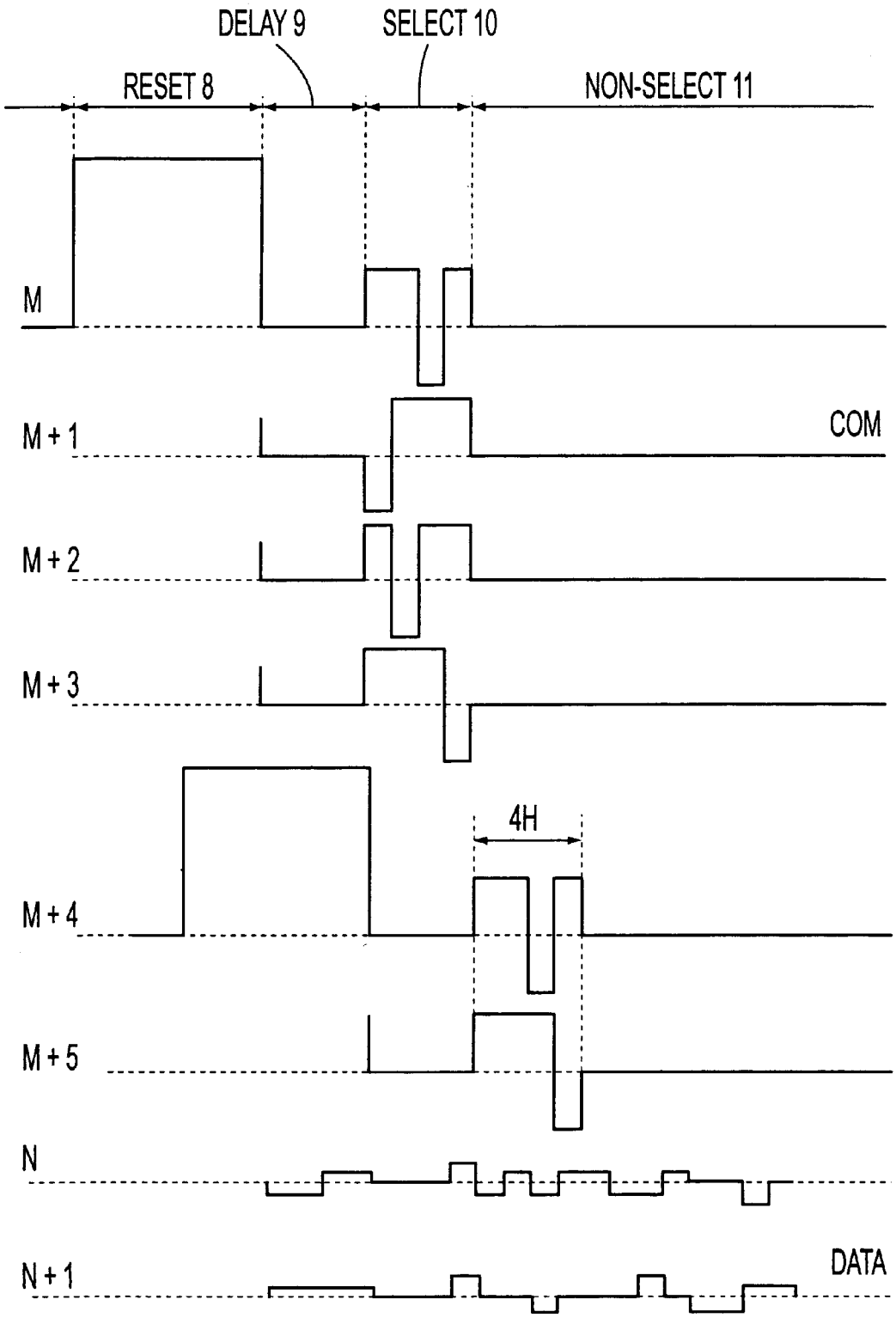
FIG. 1 is a timing chart illustrating a typical common waveform and data waveform in a case where four scanning electrodes are simultaneously selected in the present invention.

Driving waveforms in the invention are illustrated in FIG. 1. Differences from the conventional art will be described below while comparing the conventional waveforms shown in FIGS. 7 and 8 with the driving method of the invention.

FIG. 1 illustrates the driving method according to the invention, showing driving waveforms in a case where four scanning electrodes are simultaneously selected.

In FIG. 1, a scanning signal is sequentially applied to a plurality of scanning electrodes (M, M+1, M+2, M+3, M+4, . . . ), and a data signal is applied to a plurality of signal electrodes (N, N+1, . . . ). There are a plurality of scanning electrodes (row electrodes) and signal electrodes (column electrodes), and these are not limited to the illustrated configuration of scanning electrodes and signal electrodes.

A scanning signal has at least a reset pulse applied during the reset period and a selection pulse applied during the selection period. During the non-selection period, a non-selection signal is applied.

Now, the driving waveforms of the liquid crystal apparatus of the invention will be described below in detail.

The reset pulse is applied to the scanning electrodes (M, M+1, . . . ) during the reset period 8. The reset pulse is known also as a giant pulse as in the conventional art. In the present embodiment where the selection period is selected simultaneously every four scanning electrodes, the reset pulse is substantially simultaneously applied to the four scanning electrodes M, M+1, M+2 and M+3. The reset pulse has a prescribed reset amplitude as shown in the drawing, and the reset voltage has a value of substantially 20 V. While, in FIG. 1, a reset pulse is shown for the signal M, the reset pulse is represented by a simplified way for the scanning signals applied to the other scanning electrodes M+1, M+2, M+3 and M+5. It should be noted therefore that the same pulse as the reset pulse of the scanning signal applied to the scanning electrode M is applied to the other scanning electrodes M+1, M+2 and M+3. Similarly, the same pulse as the reset pulse applied to the scanning electrode (M) is applied also to the scanning electrode M+4 and the subsequent ones.

Figure 7:
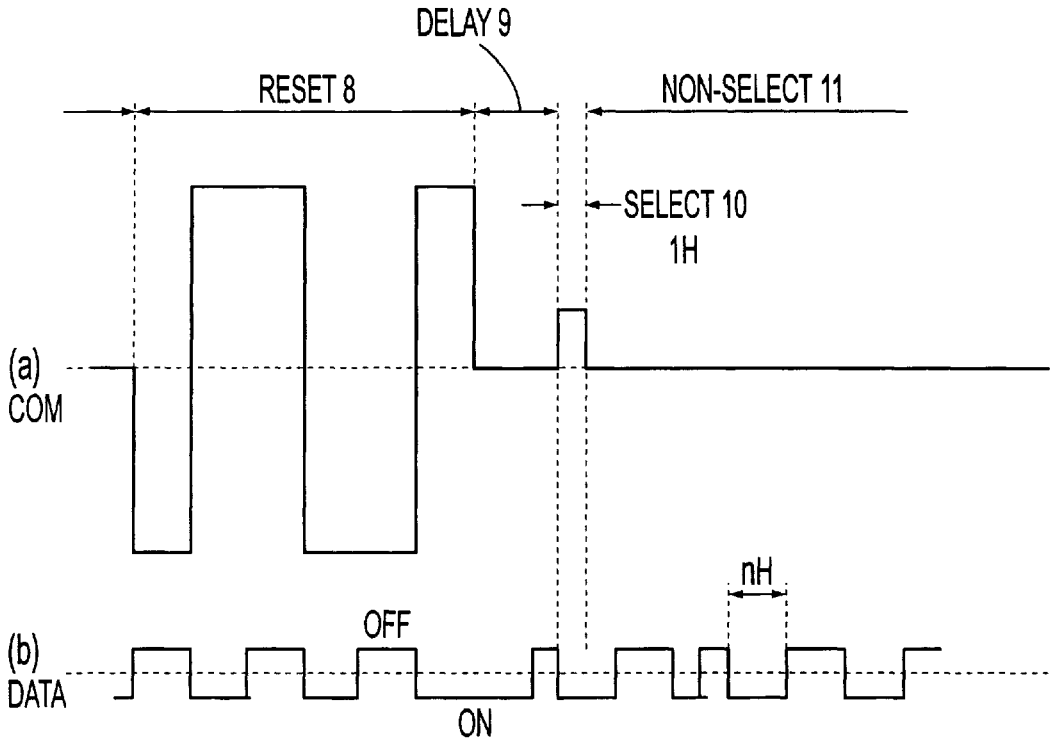
FIG. 7 PRIOR ART
FIG. 7 is a timing chart illustrating a driving method of a liquid crystal apparatus used conventionally.

The driving method shown in FIG. 7 illustrating a conventional case is one in which scanning electrodes are line-sequentially selected. In the conventional art, therefore, scanning electrodes are line-sequentially scanned, and reset pulse are sequentially applied.

In the driving method of the invention, in contrast, as shown in FIG. 1, a reset pulse is applied simultaneously to a plurality of scanning electrodes (four scanning electrodes in the present embodiment). The driving method of the invention for simultaneously selecting a plurality of scanning electrodes is therefore different from the conventional art of line-sequentially selecting scanning electrodes.

As shown in FIG. 1, the reset period 8 during which the pulse is applied is followed by a delay period 9. During the delay period, a voltage as illustrated in FIG. 1 is applied to the individual scanning electrodes within a group of divided scanning electrodes. This voltage is the reference potential (Vc). Although not shown, any voltage not exceeding the threshold voltage may be applied during the delay period with no problem.

Therefore, it is also possible to adopt a driving method of applying a pulse similar to that applied during the non-selection period within a value not exceeding the threshold voltage.

After the delay period, the first stable state or the second stable state is selected during the selection period 10. The selection period is set at an optimum timing for selection of the first stable state or the second stable state. That is, by providing the aforesaid delay period between the reset period and the selection period, the selection period can be set at an optimum timing.

During the delay period 9, a voltage is applied substantially simultaneously to the simultaneously selected scanning electrodes. Similarly, during the selection period 10 also, a selection pulse is substantially simultaneously applied to the individual scanning electrodes within the group.

For example, as shown in FIG. 1, the selection pulse to be applied during the selection period is applied to the four scanning electrodes at substantially the same timing. A selection period equivalent to a period of 4H is provided to allow access to four scanning electrodes.

Selection pulses having different waveforms are applied to the four scanning electrodes M, M+1 M+2 and M+3, respectively. By using selection pulse of different waveforms applied to the individual scanning electrodes within the group, it is possible to eliminate a threading phenomenon caused between the individual scanning electrodes in the group (the four scanning electrodes M to M+3 in this embodiment).

In the driving method of the invention, the selection of the first group including the four scanning electrodes M to M3 is followed by selection of the second group including four scanning electrodes M+4 to M+7. Groups are formed as described with each group including four scanning electrodes. The individual group are sequentially selected and a scanning signal is applied to each scanning electrode.

In the above description, a group has been formed with four scanning electrodes, and a driving method of sequentially selecting the groups has been adopted. The present invention is not however limited to four simultaneously selected scanning electrodes as in the above description. Any number of at least two scanning electrodes can constitute a group with no problem. In the driving method of simultaneously selecting a plurality of scanning electrodes, design of the driving circuit becomes more complicated according as the number of simultaneously selected scanning electrodes increases, leading to more design-related problems. Further, another problem is an increased power consumption. With these points in view, the number of scanning electrodes within a group should preferably be an even number, or more preferably, less than four.

The driving method in which a selection period equal to a time of 4H is ensured and the individual groups are selected with a shift of the timing of 4H as been described above. Setting of this selection period is not however limited to a continuous period equal to 4H, and can be devided arbitrarily. The length of a selection period therefore can be appropriately set so far as a selection period can be set at optimum timing and duration for allowing selection of the Φ−180° state and the Φ+180° state.

In the above description, furtheremore, grouping has been made in accordance with the sequence of arrangement of scanning electrodes. However, grouping may be at random, or maybe made in compliance with a prescribed cycle (for example, 1st, 5th , 9th and 13-th electrodes).

Finally, during the non-selection period 11 after the selection period, a non-selection signal is applied as shown in the drawing. That is, the signal amplitude applied during the non-selection period is the reference potential (Vc). The non-selection signal may be set at any value so far it does not exceed the threshold value.

Now, the invention will be compared with FIG. 7 showing the conventional art regarding the waveform of the scanning signal.

It is suggested that the differences from the conventional art come from (1) the placement of providing a selection period, and (2) waveform applied to the individual scanning electrodes.

Regarding (1) above, the present invention is characterized in that the scanning signal to be applied to a plurality (four, for example) of scanning electrodes is substantially simultaneously applied. Particularly, during the selection period 10, the selection signal is applied substantially simultaneously to the individual electrodes.

Regarding (2) above, the invention is characterized in that selection signals applied to the individual scanning electrodes have different waveforms from each other so as to discriminate between them. This is effective for eliminating the problem of threading.

In general terms, the scanning signal applied to the scanning electrodes is applied as follows.

More specifically, a plurality of scanning electrodes are grouped into P groups and the individual groups are sequentially selected. The scanning signal is substantially simultaneously applied to the scanning electrodes in each group. Particularly, the selection signal applied during the selection period is substantially simultaneous to the scanning electrodes in the group. The selection signals are characterized by different waveforms between different scanning electrodes. The selection signals should preferably be set so that the determinant representing the selection signal applied to the simultaneously selected scanning electrodes exhibits "orthogonality".

By setting selection signals as described above, it is possible to prevent display defects such as "threading" and "flickering" for each scanning electrode.

Figure 8:
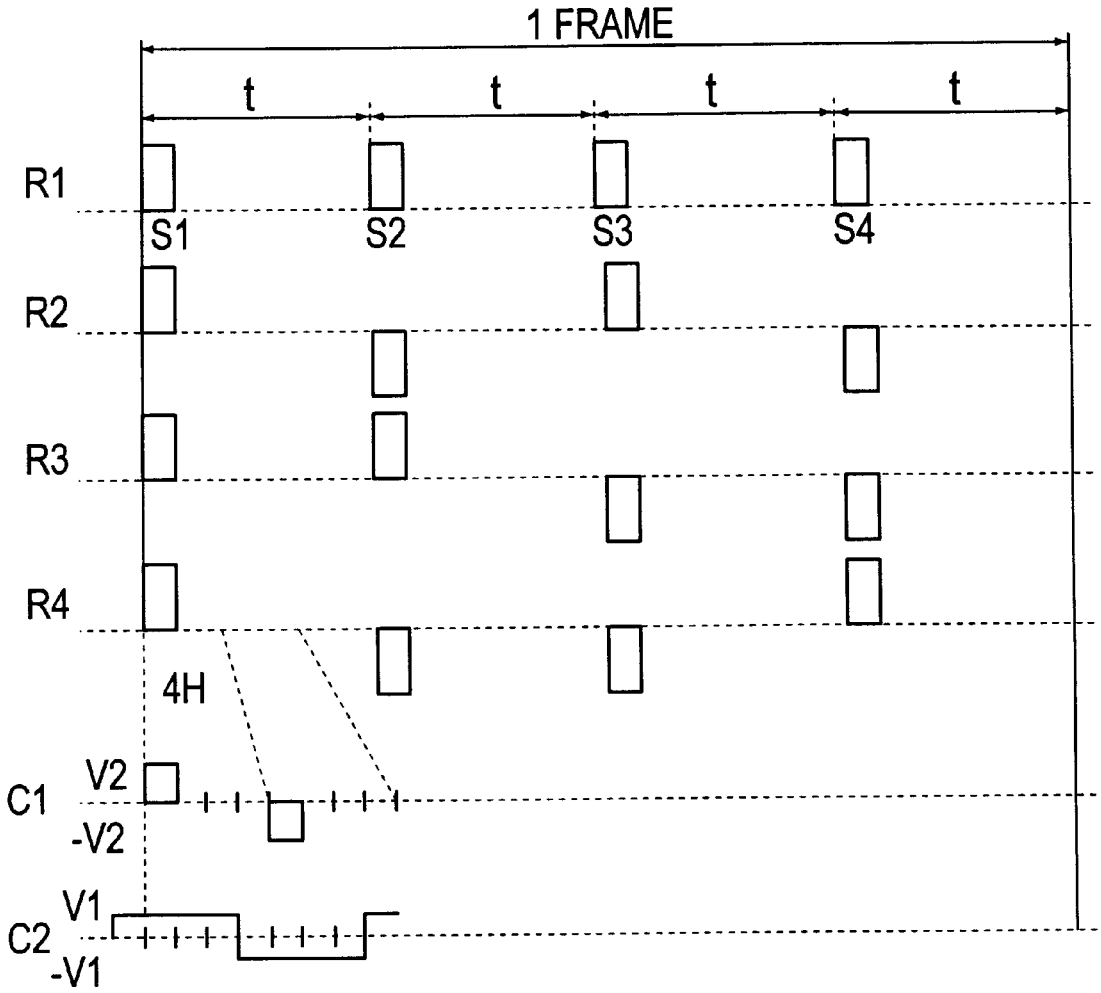
FIG. 8 PRIOR ART
FIG. 8 is a timing chart illustrating an example of MLS driving method for STN liquid crystal panel as a conventional art.

FIG. 8 gives a drawing illustrating the conventional driving method of an STN-type liquid crystal panel. The term STN-type liquid crystal panel means a liquid crystal panel using a super twisted nematic liquid crystal in which the liquid crystal has a twisted angle of at least 120°. As clear from FIG. 8, the driving method of a conventional STN-type liquid crystal panel comprises the step of dispersing selection periods at equal intervals within a frame.

Basically, the driving method forming the base of the present invention differs from the driving method of the STN-type liquid crystal panel in that (1) a reset pulse is applied, and (2) after the delay period, the selection pulse is applied, and quite different from the latter also in the orientation of liquid crystal molecules as shown in FIG. 17.

Particularly in terms of the driving manner, comparison of the driving method of the invention and the driving method of an STN-type liquid crystal panel shown in FIG. 8 reveals the following differences.

While the conventional driving method of an STN-type liquid crystal panel divides (or disperses) a plurality of selection periods at equal intervals within a frame, the driving method of the invention does not adopt such a driving manner of dispersing the selection periods within a frame. The driving method of the invention is largely different in that it is of a concentrical type or of a collection type applying within a short period of time.

These differences come from the fact that the liquid crystal apparatus used in the present invention shows a behavior simultaneously provided with a response by pulse and a response based on RMS value in the selection period after the delay period following the reset pulse (hereinafter referred to as the "pulse+ RMS value responding behavior"). More specifically, the liquid crystal apparatus used in the invention can convert an applied pulse into a plurality of pulses thereof if the RMS value does not vary in a time zone included in a certain period of time. The selection pulse applied to the four scanning electrodes as in the above case may be concentrically applied during the selection period, and the same display effect is available even by placing a slight interval between the applied pulses as in the embodiment presented later.

Further, the selection pulse applied during the selection period applicable here contains waveforms having orthonormal property as described above and not having those, and the selection thereof is arbitrary. For information, this certain period after the delay period is considered to be within 4 ms response time until entrance into a stable state at the room temperature.

Data signals applied to signal electrodes N, N+1 and the like are on the other hand as shown in FIG. 7. In accordance with the display states (ON/OFF combinations of 16 cases) at each one signal electrode (column electrode) crossing the four scanning electrodes (row electrodes) applied with the scanning signal, the combination of data signal corresponding to the selection pulses (4H period) appear. Data signals are then applied in succession to the individual signal electrodes. AC conversion of these waveforms may be inversed for each frame, or every several H (1H corresponding to the minimum selection time of 1 line) to several tens of H.

Further, the simplest positive/negative waveforms with the reference potential (Vc: zero voltage, for example) as the symmetric centerline have been presented to simplify description of the invention. It is however applicable also to a driving waveform using two groups of power supply of low and high voltages, when the differential waveform applied to the liquid crystal layer results in the same waveform as in FIG. 1.

EXAMPLE 1

A liquid crystal apparatus comprising a matrix of 120 rows×160 columns was prepared, and a driving method of applying scanning signals simultaneously to four scanning electrodes was applied on the basis of the driving waveform shown in FIG. 1. Scanning signals as shown in FIG. 1 was applied to four scanning electrodes M, M+1, M+2 and M+3.

The scanning signals applied to the scanning electrodes comprised a reset pulse (or a reset signal) applied during the reset period (Reset 8), a delay signal (or a non-selection signal) applied during the delay period (Delay 9), a selection pulse (or a selection signal) applied during the selection period (Select 10), and a non-selection signal applied during the non-selection period (Non-Select 11). In the subsequent examples, definitions of these periods shall be the same.

Timing of application of the scanning signal is substantially simultaneous for all the scanning electrodes within the group. In the present specification, "substantially simultaneous" includes cases where scanning signals are applied with a slight shift. In this example, four scanning signals applied to the individual scanning electrodes have waveforms different from each other.

After selection of a group consisting of four scanning electrodes M to M+3, scanning is sequentially conducted every four scanning electrodes. The same applies for M+4 and subsequent scanning electrodes. All the groups are thus sequentially selected to complete scanning of all the scanning electrode.

Figure 2:
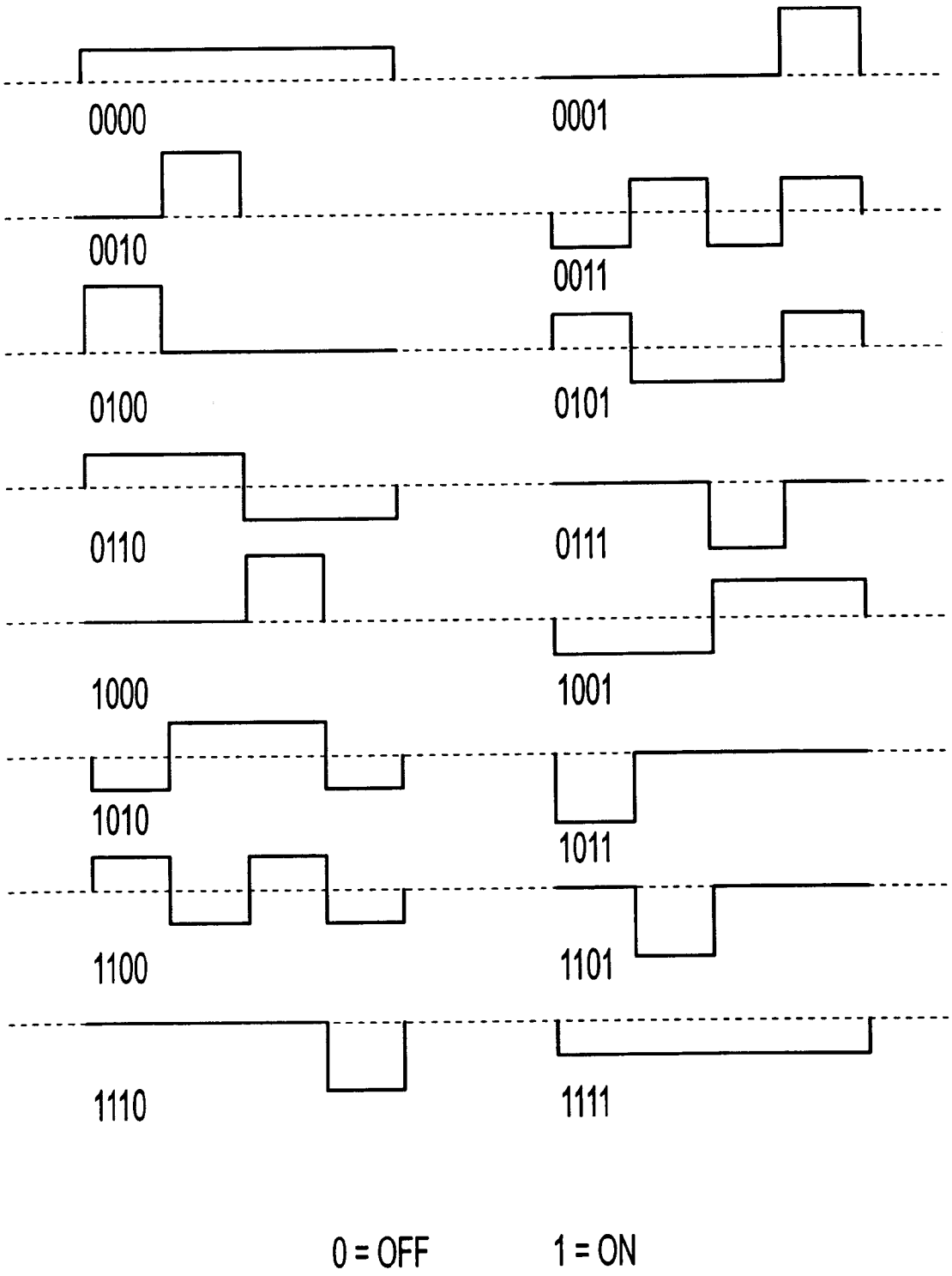
FIG. 2 illustrates 16 data waveform diagrams used when simultaneously selecting the four scanning electrodes shown in FIG. 1.

On the other hand, data signals applied to the signal electrodes (column electrodes) comprise 16 combinations of signals as shown in FIG. 2, in response to the status of display of picture elements corresponding to four scanning electrodes. The RMS value of voltage applied to the liquid crystal media can take the maximum ON/OFF ratio by combining FIGS. 1 and 2.

The liquid crystal apparatus was driven at a duty of 1/240, with 70 $\mu$s per 1H and a frame frequency of 60 Hz. Other conditions are as follows. Reset voltage: 21 V, and selection voltage: 3.5 V, or, reset voltage: 24 V, and selection voltage: 4.0 V. The data reference voltage Vb was varied near 1.3 V (the data voltages consist of five levels of ±Vb, ±0.5 Vb and 0). A variable range within which a normal test pattern is available was measured as a driving voltage margin $\Delta V$. Three test patterns were provided: 1) a black/white lattice pattern, 2) a horizontal stripe pattern consisting of repeated ON/OFF for each row, and 3) a vertical stripe pattern consisting of repeated ON/OFF for each column. As a result of display, all three patterns could be normally displayed, and although pattern dependency was observed, a margin equal or superior to that in the conventional art shown in FIG. 7 was obtained.

Then, the driving method of the invention was compared with the conventional method under severer driving conditions including a duty ratio of 1/480 and 35 $\mu$s per 1H. In this case also, a drive margin equivalent to that in the conventional method, and for some patterns, a drive margin superior to that in the conventional method was obtained.

EXAMPLE 2

Figure 3:
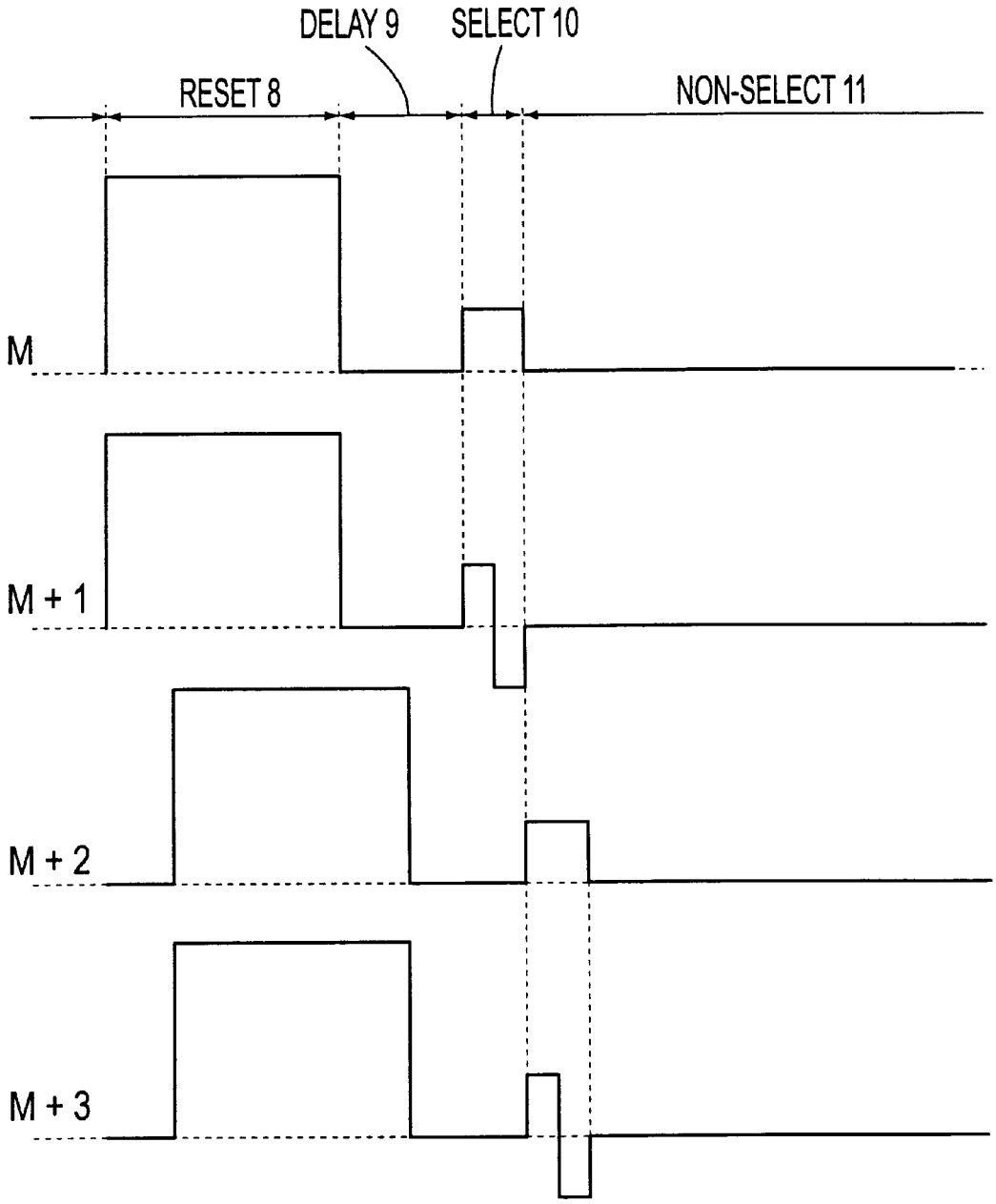
FIG. 3 is a common waveform diagram used in an embodiment in which two scanning electrodes are simultaneously selected according to the invention.

FIG. 3 illustrates another driving method. More particularly, each group was composed of two scanning electrodes, and the individual groups were sequentially selected. Scanning signals were applied simultaneously to the two scanning electrodes within each group.

As in the driving method described above in the Example 1, selecting four scanning electrodes at a time, reset pulses were applied to the scanning electrodes during the reset period 8, and after the delay period 9 following the reset period, selection pulses are applied during the selection period 10. During the selection period 10, two different kinds of selection pulses were given to the scanning electrodes for simultaneous selection of the two scanning electrodes.

Figure 4:
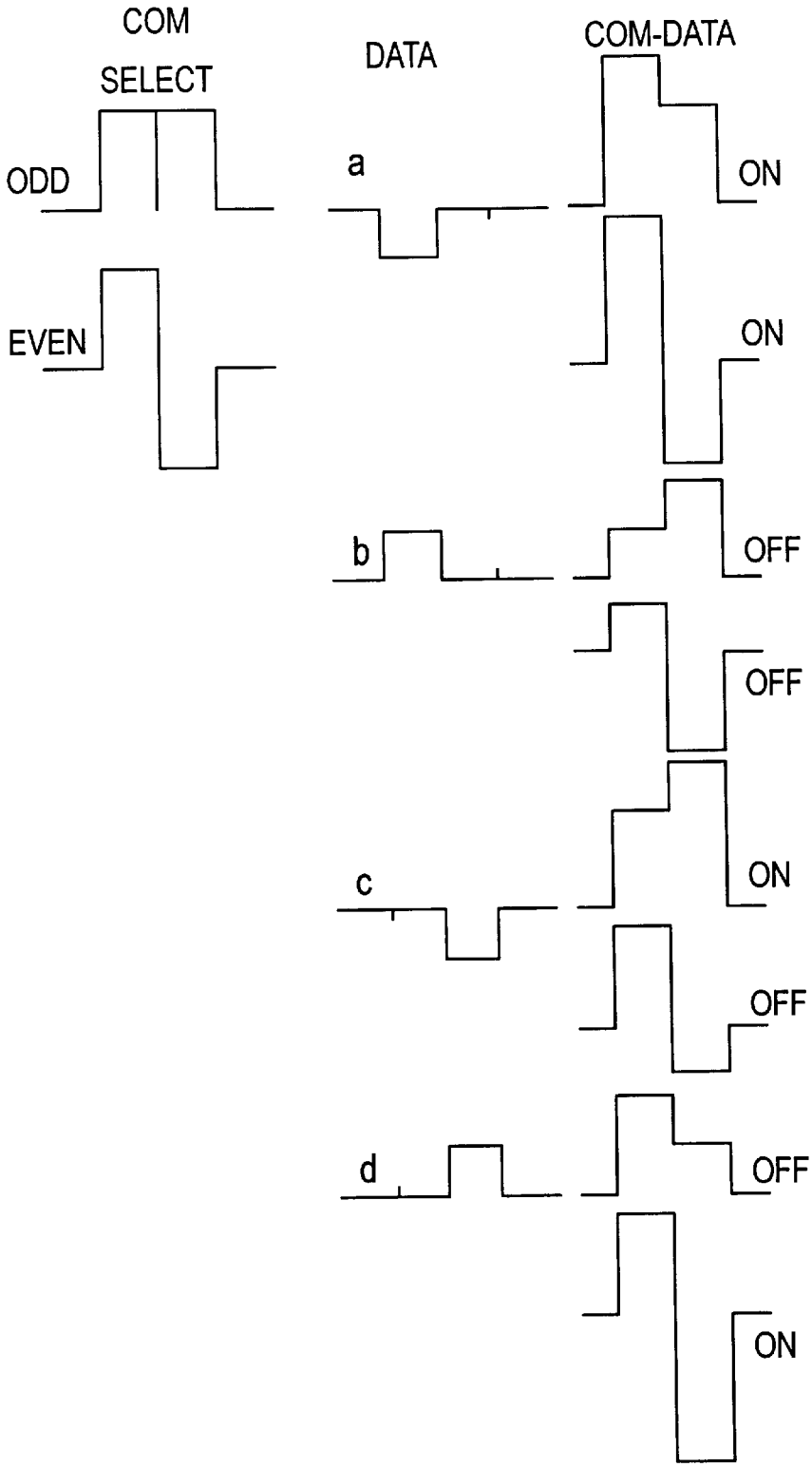
FIG. 4 is a waveform diagram illustrating a common waveform, a data waveform and the difference therebetween during the selection period shown in FIG. 3.

Accordingly, four kinds of data signal a to d shown in FIG. 4 are applied to the signal electrodes in response to the contents of display. In FIG. 4, the scanning signal applied during the selection period is represented by "COM select"; the data signal applied to the signal electrodes is represented by "Data"; and the differential waveform, by "COM-Data".

The liquid crystal cell in this example was a simple 120×160 matrix type liquid crystal cell as in the Example 1. The drive duty ratio was 1/240. The pulse amplitude of driving waveform and other various conditions were the same as in the Example 1. However, the reference voltage Vb of data signal was varied around 1.8 V. The same three test patterns were displayed with this drive waveform as in the Example 1. As a result, a driving voltage margin of from 140% to 200% far exceeding that of the conventional method was obtained for any of the patterns.

EXAMPLE 3

Figure 5:
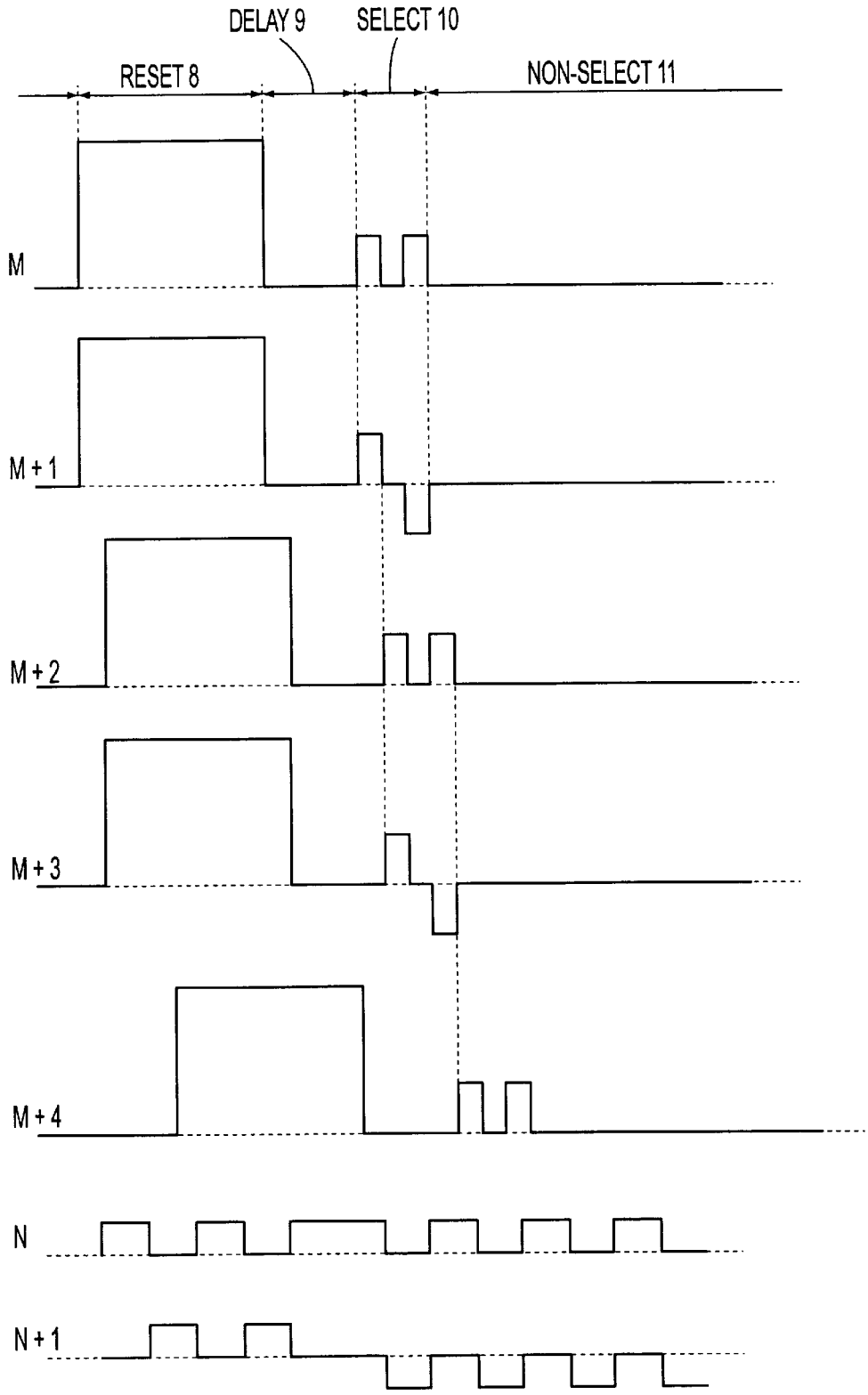
FIG. 5 is a timing chart of a common waveform and a data waveform in a case where selection pulses are divided and two scanning electrodes are simultaneously selected in the invention.

In this example, a driving method as shown in FIG. 5 was adopted. More specifically, the method in the Example was the same as the drive method shown in the foregoing Example 2 in that two scanning electrodes were simultaneously selected. The present example differs from the Example 2 in that selection pulses applied during the selection period were divided into two parts, and a gap of at least 1H is provided between pulses. In the present specification, this driving method is referred to as the "split type" of and applying a divided selection pulse.

Data signals were applied to the signal electrodes in conformance with the timing of each selection period. At a timing corresponding to the selection period, the data signals divided into two in response to the aforesaid selection pulses were applied to the signal electrodes.

The basic waveforms in this Example were the same as those shown in FIG. 4. The driving voltage conditions were the same as those in the Examples 1 and 2. As a result, in the 1/240 addressing, a sufficient driving voltage margin superior to that in the conventional method was observed for all test patterns. Particularly, for the vertical stripe pattern, a weak point of the conventional method, a margin more than four times as large as that in the conventional driving method was ensured, thus permitting confirmation that this was a stable driving method.

Then, the liquid crystal panel used in this Example was driven at a duty ratio of 1/480, and a driving voltage margin equal or even superior to that in the conventional method was obtained. The method of the invention was superior to the conventional method particularly within a voltage range making the aforesaid three patterns drivable in common.

EXAMPLE 4

Figure 6:
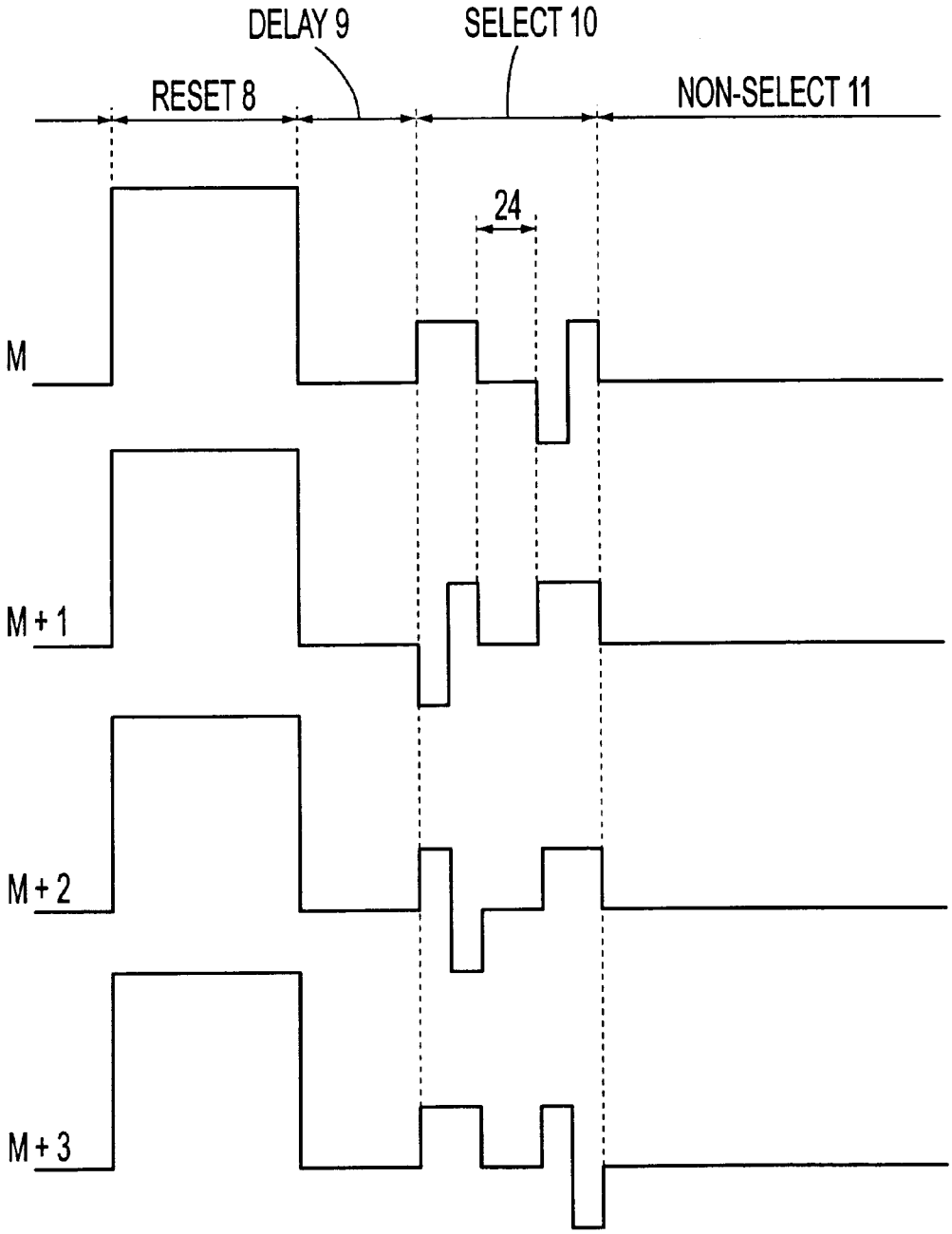
FIG. 6 is a common waveform diagram in a case where selection pulses are divided and four scanning electrodes are simultaneously selected in the invention.

In the Example 4, a liquid crystal apparatus was driven by a driving method as shown in FIG. 6.

As shown in FIG. 6, the driving method of applying scanning signals simultaneously to four scanning electrodes was adopted in this Example. This driving method was the same as that in the foregoing Example 1. The method used in this Example 4 was different from that used in the Example 1 in that selection pulses were divided for application. In this Example, as shown in FIG. 6, an interval of 2H was provided at the center of the selection pulses. That is, adoption of a "split" type driving method is different from the Example 1 described above. The present Example differs from the Example 3 in that four scanning electrodes were simultaneously selected.

In this Example, as described above, the "split" type method of dividing the selection pulses for application was adopted. In conformance with the application of the divided selection pulses to the scanning electrodes, data signals as well were applied in the form of being divided into two, at a timing aligned with that of the selection period. That is, the waveform of data signal shown in FIG. 1 or 2 was divided in response to the divided selection pulses as shown in FIG. 6 and applied to the signal electrodes.

A driving duty ratio was 1/480, with the other conditions similar to those in the Example 1. A liquid crystal apparatus was driven by the use of the driving method of this Example: a driving margin superior to that obtained in the Example 1 was observed for any of the three kinds of pattern.

EXAMPLE 5

Figure 11:
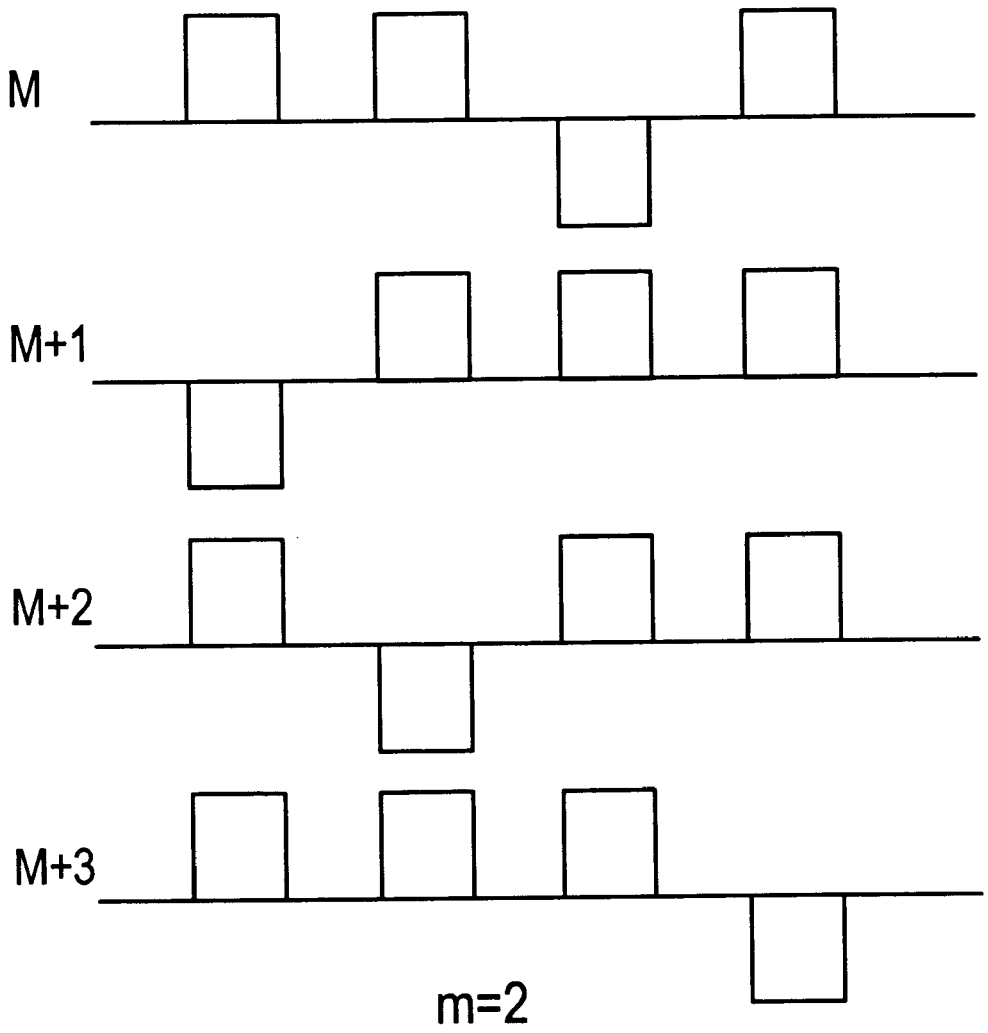
FIG. 11 is a common waveform diagram in a case where four dispersion type scanning electrodes are simultaneously selected in the invention.

The driving method used in the Example 5 is illustrated in FIG. 11. This driving method is an improvement of the driving method shown in FIG. 1. That is, in the driving method used in the Example 5, four scanning electrodes were selected simultaneously, and selection pulses applied during the selection period were divided into a plurality of periods. The driving method in which the selection pulses are dispersed within the selection periods as shown in FIG. 11 is associated also with those used in Examples 3 and 4 described above.

For convenience of description, m is used as an index representing the degree of dispersion. That is, m=1 represents the state of FIG. 1, corresponding to a driving method in which selection pulses are concentrically applied. Or, it is a driving method in which selection pulses are not dispersed. The state m=2 is shown in FIG. 11. In this method, selection pulses are dispersed, and pulses are applied at prescribed intervals 1H in this Example). The state m=3 represents a driving method in which an interval of 2H is provided between the selection pulses. Accordingly, as m increases, the setting is made so that a wider interval is provided between the selection pulses.

It suffices that the data waveform is applied to the signal electrodes by dispersing the waveform shown in FIG. 2 in synchronization with dispersion of the selection waveform.

Using the driving method as described above, a liquid crystal apparatus was driven at a duty ratio of 1/240 as in the preceding Example. Margins were compared among cases with a degree of dispersion changed to m=1 to 4. The case with m=2 (i.e., the interval between pulses set to 1H) gave the highest margin for all the three patterns, and m=4 showed the lowest result. It is suggested that an excessive dispersion of the selection pulses exerts an adverse effect on the display of the liquid crystal apparatus used in this Example. There exists an optimum application time interval for the application of the selection pulses after the delay period. The effective time interval is for a short period of time of 1 to 2 ms after application of the reset pulses.

However, since the application of the selection pulses to the scanning electrodes dispersed during the selection period has a favorable effect as described above, a liquid crystal apparatus having excellent display properties is available by appropriately setting a degree of dispersion in response to the liquid crystal apparatus.

EXAMPLE 6

Figure 12:
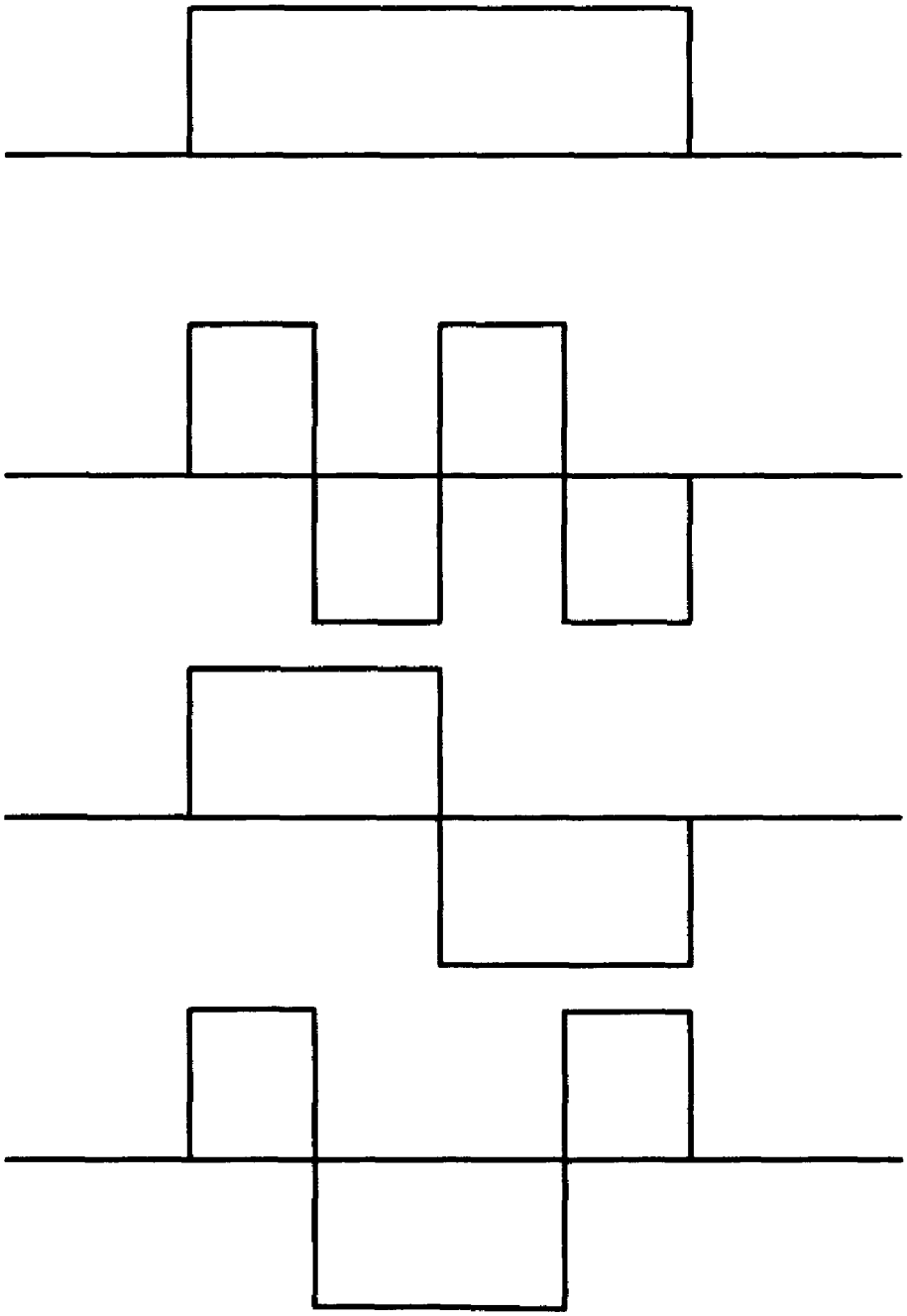
FIG. 12 illustrates an embodiment of the invention, showing a common waveform set in accordance with an Hadamard matrix in a case where four scanning electrodes are simultaneously selected.

Selection pulses applied to the scanning electrodes in the Example 6 are illustrated in FIG. 12. In this Example, a driving method of simultaneously selecting four scanning electrodes was adopted. The selection pulses applied to the scanning electrodes are as shown in FIG. 12: the selection pulses are set on the basis of an orthogonal functional matrix. That is, in FIG. 12, selection pulses applied to four simultaneously selected scanning electrodes are shown. This is expressed in the following determinant. The waveforms shown in FIG. 12 are expressed with a reference potential (Vc) represented by a horizontal line as reference, with 1 for the positive and 0 for the negative side. It takes the following form:

TABLE 1

$$\begin{pmatrix} 1 & 1 & 1 & 1 \\ 1 & 0 & 1 & 0 \\ 1 & 1 & 0 & 0 \\ 1 & 0 & 0 & 1 \end{pmatrix}$$

More specifically, the matrix of the selection pulses applied to the first row of the scanning electrodes is (1111). The pulse shown in FIG. 12 is applied to one of the scanning electrodes in the group. The matrix of the second row, the third and the fourth rows are as shown in FIG. 12 and in the above-mentioned determinant.

Figure 13:
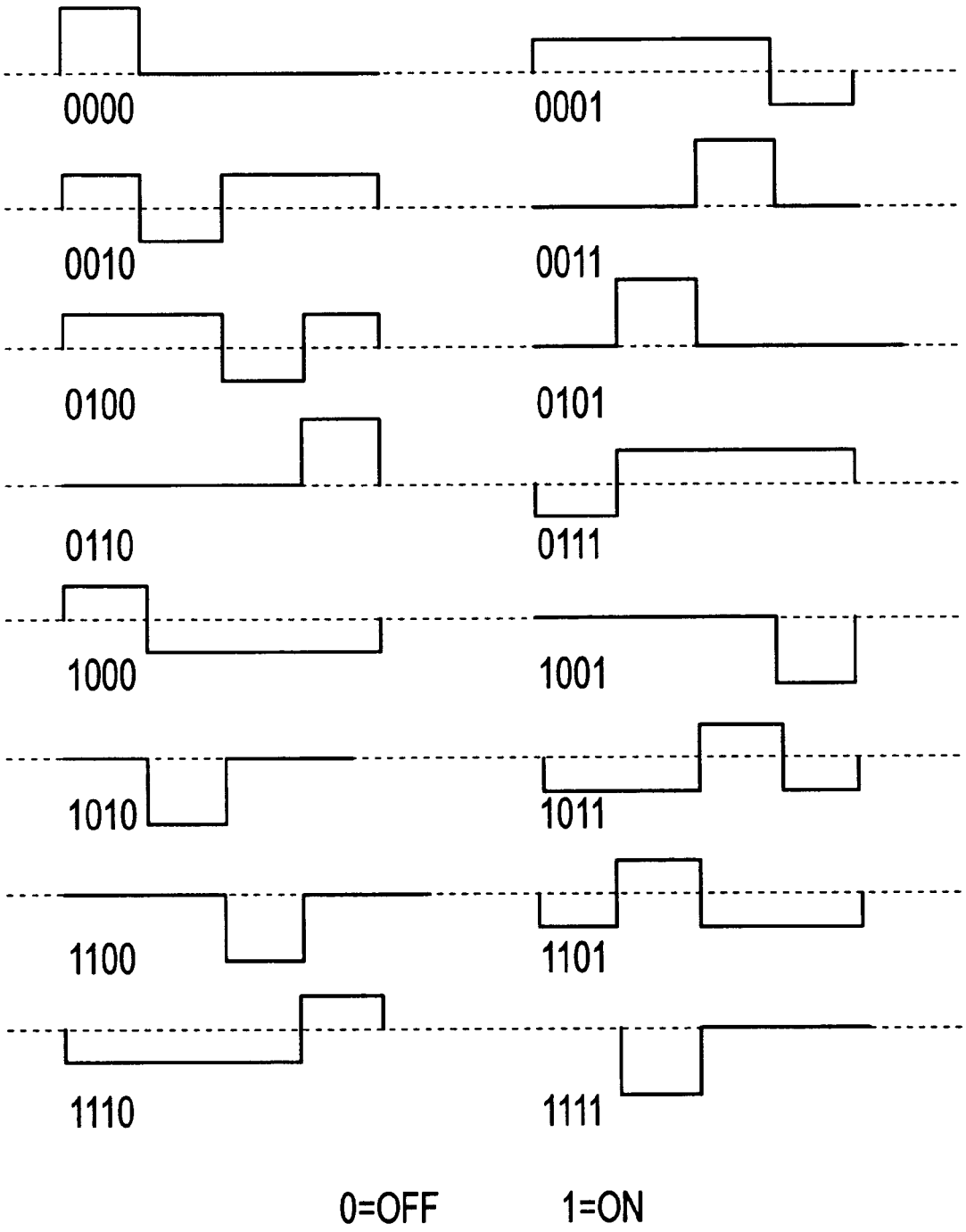
FIG. 13 is a data waveform diagram corresponding to the common waveform showing in FIG. 12.

The selection pulses applied during the selection period were set in compliance with the matrix comprising a Hadamard matrix in the present Example. Because the driving method of selecting four scanning electrodes at a time was used in this Example, a determinant comprising four rows and four columns as above was used. The data waveforms corresponding to the selection pulses on the basis of such a Hadamard matrix take the form as shown in FIG. 13.

This determinant varies with the number of simultaneously selected scanning electrodes. For example, it is possible to set selection pulses on the basis of a determinant with A rows and B columns, where A is the number of simultaneously selected scanning electrodes and B is the number of pulses or the number of divisions of the selection period.

The driving method in this Example is the same as in the Example 1 with a driving duty ratio of 1/240. The driving voltage margin upon display of the three foregoing test patterns was measured. The margin was superior to that of the conventional method for any of the patterns. By setting selection pulses on the basis of the Hadamard matrix, the best margin and display property were obtained.

While the selection pulses were set on the basis of the Hadamard matrix in the present Example, the setting is not limited to a Hadamard matrix, but may be made on the basis of a general "orthogonal function". By setting mutually different selection pulses to be applied to the individual scanning electrodes within the group in principle, a liquid crystal apparatus free from threading between the scanning electrodes and excellent in display property is available. Setting is not limited to a Hadamard matrix as described above, but may be made by the use of a general orthogonal function, as described above. Among others, it is particularly preferable to set a determinant as follows:

TABLE 2

$$\begin{pmatrix} 0 & 1 & 1 & 1 \\ 1 & 0 & 1 & 1 \\ 1 & 1 & 0 & 1 \\ 1 & 1 & 1 & 0 \end{pmatrix}$$

More particularly, in view of the column direction in this determinant, the first column shows (0111) from above. Voltage applied to a row should thus have a polarity different from the polarity of voltage applied to the other columns. Similar setting is made also for the other second, third and fourth columns in addition to the first column. By setting a determinant as described above, it is possible to eliminate display defects caused by the selection pulses. Regarding polarity, positive and negative areas are set relative to the reference potential (Vc) as shown in FIGS. 11 and 13. The reference potential may be considered as a non-selection signal applied during the non-selection period. The reference potential will be treated in the same manner in the above and subsequent examples.

The present example has been described above with reference to a four-row/four-column determinant, but is not limited to this. In general, setting may be made on the basis of a general formula of A rows and B columns.

EXAMPLE 7

Figure 14:
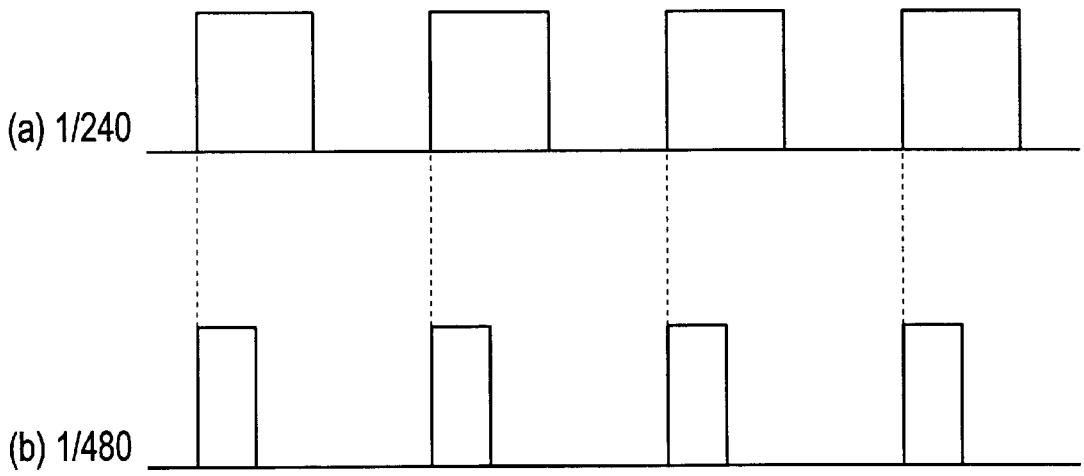
FIG. 14 is a timing chart of common waveforms composing a case with a duty ratio of 1/240 and a case with a duty ratio of 1/480.

The concept of the driving method in this Example is illustrated in FIG. 14. Particularly, (a) of FIG. 14 is a variant of the Example 6. More particularly, (a) of FIG. 14 represents a drive waveform comprising dispersed selection periods.

The degree of dispersion is expressed by means of m=2 in accordance with the above-mentioned definition, and there was provided an interval of 1H between two selection pulses applied during the selection period. The data signal applied to the signal electrodes took a dispersed waveform in conformance with this selection waveform. The data signal had the same waveform as that shown in FIG. 13, and the waveform was dispersed in response to the waveform of the dispersed selection pulse (not shown).

A liquid crystal apparatus was driven in compliance with the driving method as described above. By the application of selection pulses dispersed during a selection period, a liquid crystal apparatus excellent in display properties was obtained, with the highest driving voltage margin. The driving method was basically the same as in the preceding Example, with a duty ratio of 1/240. Display of the three foregoing test patterns gave satisfactory results.

When the liquid crystal panel was driven with a duty ratio of 1/480, on the other hand, the length of the selection period becomes a half of that with a duty ratio of 1/240, as shown in (a) of FIG. 14.

The results suggest that, in a driving method as described above, provision of an interval of 3H between the individual selection pulses is appropriate for the purpose of achieving a timing of application of the selection pulses in agreement with that of 1/240 (the degree of dispersion in this case is m=4). Under the effect of a decrease in the pulse width, the drive margin was inferior to that available with 1/240 but superior to that in the conventional method.

In this Example, the selection pulses were applied to the scanning electrodes while being dispersed as shown in FIG. 14 which symbolically illustrates the dispersion. The selection pulses as those in the foregoing Examples 1 and 4 are applied to the scanning electrodes within the groups. A liquid crystal apparatus excellent in display properties is available in this Example by dispersing the selection pulses as shown in FIG. 14. The matrix of the selection pulses may have any waveform so far as the selection pulses applied to the individual scanning electrodes have mutually different waveforms. The selection pulse should however be preferably set by means of a matrix set on the basis of a Hadamard matrix or an orthogonal function as in the preceding Example 6.

EXAMPLE 8

The Example 8 covers a variant of the case where four scanning electrodes are simultaneously selected, i.e., a case where three scanning electrodes are simultaneously selected.

In this Example, a driving method for a case where three scanning electrodes are simultaneously selected was achieved on the basis of the concept for a case where four scanning electrodes are simultaneously selected.

The basis concept of the driving method in this Example is as follows.

A plurality of scanning electrodes are grouped into a plurality of groups as in the preceding Example. More specifically, a plurality of scanning electrodes are grouped into a group. In this Example, three scanning electrodes are set from among the scanning electrodes within each group, and a virtual electrode is set for each group. The virtual electrode and actual scanning electrodes are combined into four scanning electrodes, and a scanning signal is applied to each scanning electrode. The virtual electrode is essentially non-existent, and virtually assumed to be existent. It is assumed that a scanning signal is applied to this virtual electrode.

By setting a virtual electrode for each group and assuming that a scanning signal is applied to the virtual electrode, it is possible to drive a liquid crystal apparatus by the same driving method as that of simultaneously selecting apparently four scanning electrodes.

Further, by adopting such a driving method, it is possible to lower the voltage level of data signals applied to the signal electrodes. That is, when comparing the selection pulse and the status of display, the number of agreement/non-agreement can be reduced, thus bringing about an advantage of eventually lowering the voltage level of the data signals determined on the basis of the number of agreement/non-agreement, by assuming that the pulses applied to the virtual electrode are in agreement with the status of display on the virtual electrode.

A configuration with a simple virtual electrode has been described above. Two or more virtual electrodes may however be set. The number of simultaneously selected scanning electrodes including one or more virtual electrode is not limited to four. A plurality of actually existent scanning electrodes are set, with at least one virtual electrode, and these are combined into a group with no problem.

Now, the driving method in this Example will be described further in detail.

First the description will be based on FIG. 1 (corresponding to Example 1). FIG. 1 illustrates the scanning signal applied to the scanning electrode. As shown in FIG. 1, the scanning signal is applied to the scanning electrodes M, M+1, M+2 and M+3, respectively. Among these electrodes, ones corresponding to M, M+1 and M+2 are actually existing scanning electrodes, and pulses as shown in the drawing are applied thereto. In this Example, the scanning electrode M+3 is treated as a virtual electrode, and a pulse as shown in FIG. 1 is assumed to be applied thereto.

Groups each composed of three actually existent scanning electrodes and one virtual electrode are sequentially selected, and scanning signals are simultaneously applied to the scanning electrodes including the virtual electrode within each group.

At this point, the data signal applied to the signal electrode is as shown in FIG. 2. By applying the data signal as shown in FIG. 2, it is possible to select an On-state or an OFF-state of the liquid crystal apparatus.

By using eight combinations of (0001, 0010, 0100, 0111, 1000, 1011, 1101, 1110) or (0000, 0011, 0101, 0110, 1001, 1010, 1100, 1111) shown in FIG. 2, the output voltage of the data signal can be simplified into two or three levels.

As in the preceding Example, the margin was measured by means of the three patterns: three-level combinations of data waveforms gave better result. As compared with the split type in which two scanning electrodes are simultaneously selected, however, the margin was lower than the above, which was rather unsatisfactory. The cause is as follows. In the case of the driving method in which three scanning electrodes are simultaneously selected, the duty ratio which is nominally 1/240 is practically 1/320 because of the presence of a virtual electrode, and the selection period for a line decreases to 3/4. It was thus suggested that a decrease in the width of the applied pulse leads to a decrease in the margin.

In the present Example, the liquid crystal apparatus was driven on the basis of the waveform as shown in FIGS. 1 and 2. The scanning signal applied to the scanning electrode is not however limited to that shown in FIG. 1. A selection pulse may be set on the basis of an orthogonal function.

Further, as described in the preceding Example, the driving method in which selection pulses divided as shown in FIG. 14 are applied during the selection period is also applicable in the present Example.

EXAMPLE 9

Figure 15:
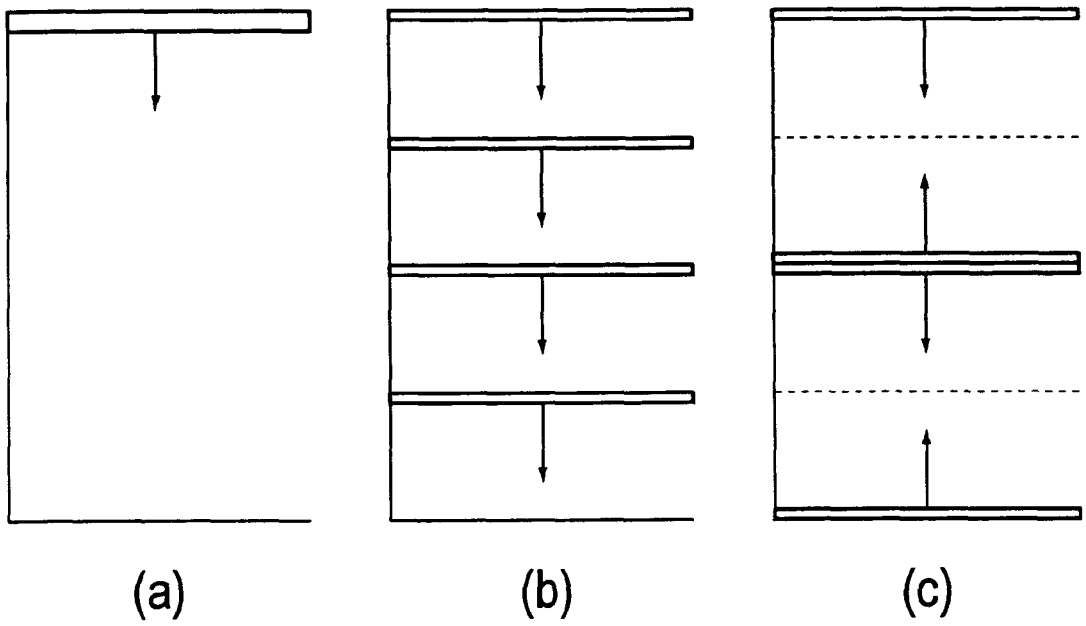
FIG. 15 illustrates three examples showing direction of scanning in a case where four scanning electrodes are simultaneously selected.

The driving method in the Example 9 is illustrated in FIG. 15. FIG. 15 will be described with reference to FIG. 1 showing the typical driving method of the invention. In a method in which four scanning electrodes are grouped into a group, and the resultant groups are sequentially selected, some variations were studied. This resulted in the scanning methods shown in FIGS. 15(*a*) to 15(*c*).

FIG. 15(*a*) illustrates a driving method of grouping every four adjacent scanning electrodes, and sequentially selecting the groups. This driving method was developed by assuming that scanning is performed from top to bottom of the display screen of the liquid crystal apparatus as in all the preceding Examples. The shadowed portion in FIG. 15(*a*) represents simultaneously selected scanning electrodes. In this Example, the driving method for scanning from top to bottom of the display screen, but this is also the case with scanning from bottom to top. In this Example, the number of simultaneously selected electrodes is not limited to four, but the selected number may be any number.

FIG. 15(*b*) illustrates a driving method comprising the step of dividing the display screen of the liquid crystal apparatus into four blocks, selecting one scanning electrode for each of the four blocks, and sequentially scanning one scanning electrode for each block. A group is formed from scanning electrodes selected in each block. That is, a group is formed from four scanning electrodes including one scanning electrode from the block 1, one scanning electrode from the block 2, one scanning electrode from the block 3 and one scanning electrode from the block 4. The block is set in response to the number of simultaneously selected scanning electrodes.

FIG. 15(*c*) is a variant of FIG. 15(*b*): when the upper is the block 1 and the lowermost on is the block 2, scanning is effected from top of the display screen for the block 1 and 3, and scanning is made from bottom of the display screen for the blocks 2 and 4.

In FIG. 15 showing this example, each portion represents a display screen and the top in the drawing represents the top of the display screen.

A liquid crystal apparatus was driven in accordance with these three scanning methods. The result confirmed that there was no difference in display properties among the three methods. That is, it was confirmed that there was no limitation in the manner of line scanning of a display. As an advantage in an area other than driving method, a decrease in noise caused upon driving the liquid crystal apparatus was recognized by adopting a scanning method such as that shown in FIG. 15(*b*). This suggests that liquid crystal molecules to be excited should preferably be dispersed in the apparatus.

EXAMPLE 10

Figure 16:
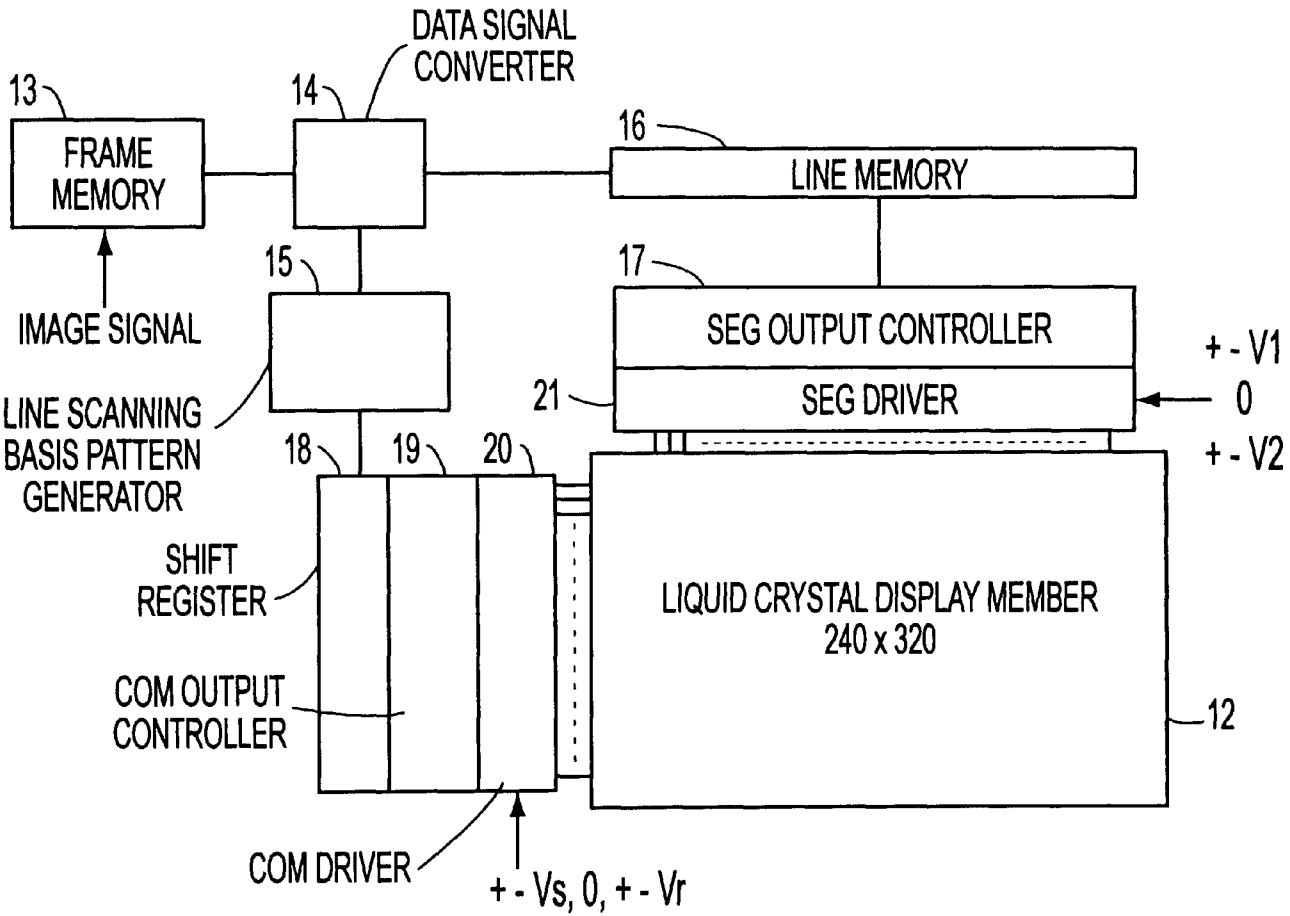
FIG. 16 is a circuit configuration diagram for application of the invention.

FIG. 16 illustrates a configuration of the liquid apparatus of the invention. In this Example, a configuration of a driving circuit for turning on a liquid crystal display member 12 having a display capacity of 240×320 is shown. When the display capacity is larger that this, the configuration should be expanded.

An image signal is once stored in a frame memory 13 as an image data corresponding to the individual horizontal lines, and data for the column direction of a plurality of simultaneously selected scanning electrodes are entered into an SEG data signal converter 14 in parallel from a smaller column number. When, for example, the driving method is of selecting simultaneously four scanning electrodes, four-bit data for four rows are sequentially transferred in parallel from column number 1 to 320.

A line scanning signal basis pattern generator 15 is, on the other hand, used to generate a matrix forming the basis for a scanning signal (COM waveform) such as that shown in FIGS. 1 and 12. For example, Table 1 shows the case of the waveform shown in FIG. 12, and Table 2, the case of the waveform shown in FIG. 1. These tables respectively form matrices forming the basis for selection pulses. In the tables, "1" corresponds to selection pulse voltage +Vs, and "0", to selection pulse voltage −Vs, where ±Vs is a value based on the reference potential (Vc). The same description as above applies here.

Upon receipt of a parallel signal from the frame memory side, the data signal converter 14 provides an output of the sequence number (for example, waveforms Nos. 0 to 4 as shown in FIG. 2 or 13) of a voltage level of the data signal actually applied from an ROM Table, as derived from a pattern of selection pulses read in simultaneously with the data pattern.

The results are stored in a plurality of line memories 16 (for four horizontal scannings when four scanning electrodes are simultaneously selected), and upon completion of conversion of all signals applied to the simultaneously selected scanning electrodes, are sent as an output to an SEG output controller 17 in parallel line by line.

A signal from the line scanning signal basic pattern generator 15 is processed, on the other hand, depending upon which of the scanning methods (a), (b) and (c) in FIG. 15 is to be adopted at a shift register 18.

For example, in the driving method in which four scanning electrodes are simultaneously selected, in the case of the scanning as shown in FIG. 15(*a*), a 4-bit selection pulse from the basic pattern generator 15 is received at the first 4-bit register of 240-channel shift registers. At the next timing, the pulses for 240 channels including the other vacant registers are simultaneously passed to a COM output controller 19. This operation is repeated four times, and upon completion of passage of data during four selection periods, the register access position is shifted by four channels, and the same cycle of operations is repeated. Operations for 240 lines/one frame are completed with a repetition of 60 times.

In the case of a scanning pattern shown in FIG. 15(*b*) or 15(*c*), the position of the register receiving 4-bit pattern of selection waveform is dispersed by one bit each to the four groups, and it suffices to select the shifting direction of the receiving register upward or downward.

The reset pulse shown in FIG. 1 is required prior to selection waveform for ON/OFF control of liquid crystal display. There is therefore provided another system of shift register for reset pulse. This sends a duration of reset to the COM output controller 19.

When data for 240 rows and 320 columns are thus provided in the shift register or the line memory, the contents thereof are simultaneously passed to the COM output controller 19 or the SEG output controller 17 by a 1-horizontal scanning time clock. Because positive/negative symmetrical select voltage, reset voltage and non-select voltage are provided on the COM side, any one voltage is selected in compliance with the control signal, and the selected signal is sent as an output from a COM liquid crystal driver 20.

Similarly, a plurality of data voltages are provided at the symmetric position with a non-select voltage on the SEG side. Any one voltage is selected in compliance with the SEG output control signal, and a selected signal is provided as an output from the SEG liquid crystal driver 21. The number of voltage levels necessary on the SEG side is five levels in the case of simultaneous selection of four lines, and three levels in the case of simultaneous selection of two lines.

A driving circuit having the above configuration was provided, and a liquid crystal apparatus (or a liquid crystal display member) 12 was turned on with image signals from a personal computer as a source. The result permitted configuration of a display quality superior to that of the display member based on the conventional super twist nematic liquid crystal. Even as compared with a liquid crystal apparatus based the conventional driving method, a liquid crystal display excellent in driving voltage margin and contrast ratio was confirmed.

EXAMPLE 11

In this Example, a case where the liquid crystal apparatus described above in the preceding Examples 1 to 10 was mounted on an electronic equipment will be described.

Figure 18:
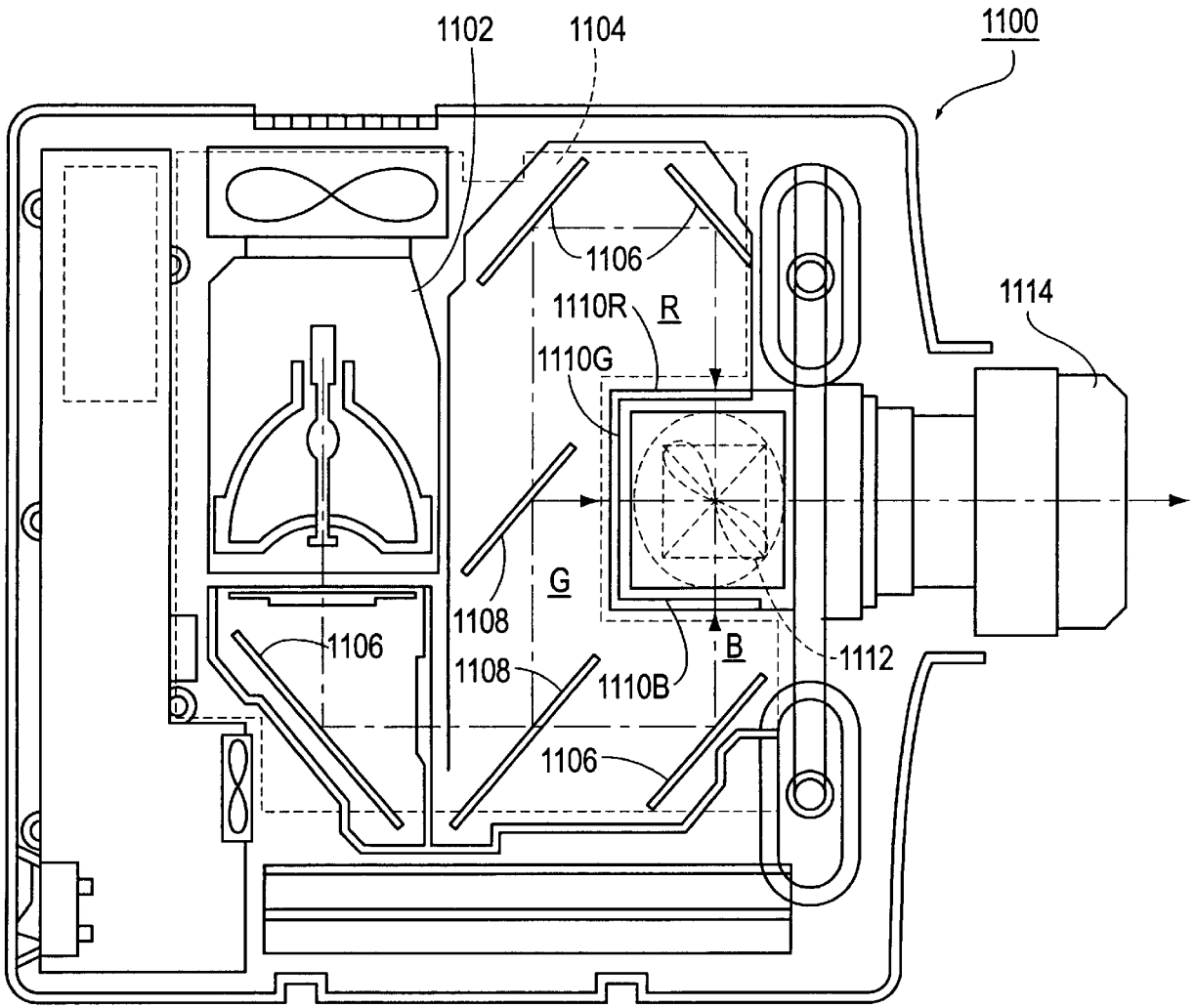
FIG. 18 illustrates the liquid crystal apparatus of the invention used for a projector.
Figure 19:
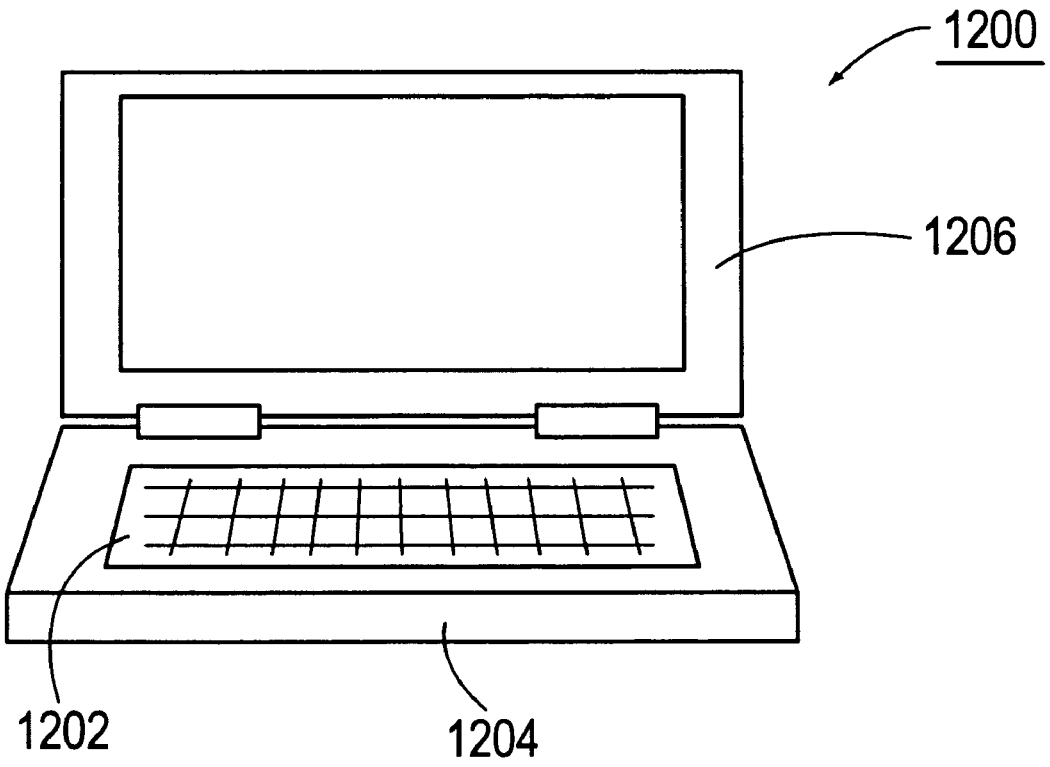
FIG. 19 is a configuration diagram of the liquid crystal apparatus mounted on an electronic equipment.
Figure 20:
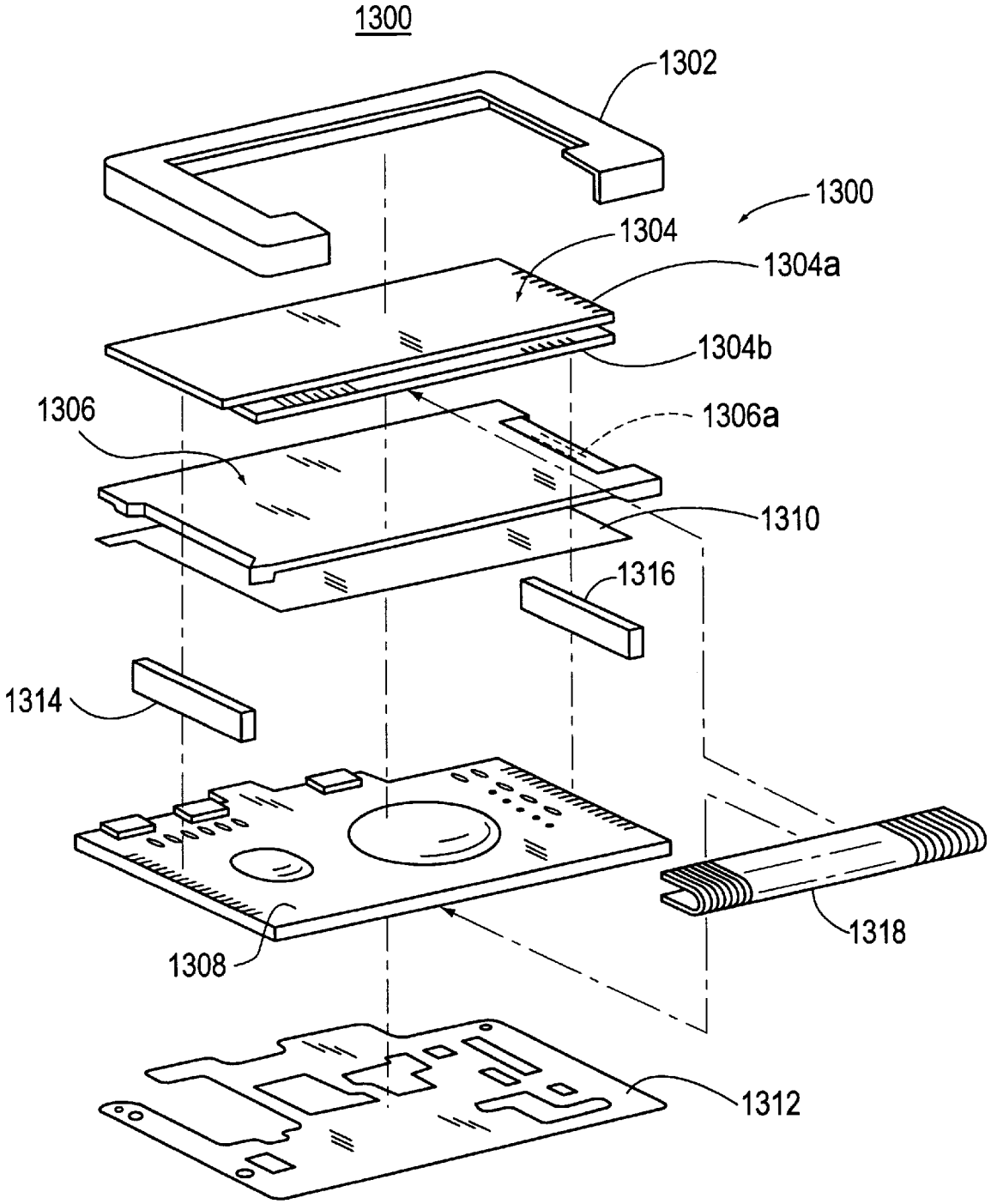
FIG. 20 is another configuration diagram of the liquid crystal apparatus mounted on an electronic equipment.

Applicable electronic machines include a liquid crystal projector shown in FIG. 18, a personal computer (PC) and an engineering workstation capable of coping with multimedia shown in FIG. 19, a pager or portable mobile phone shown in FIG. 20, a wordprocessor, television set, a viewfinder type or a monitor direct viewing type video-tape recorder, an electronic notebook, an electronic desk-top calculator, a car navigation unit, a POS terminal, and a device provided with a touch panel.

FIG. 18 illustrates a liquid crystal projector. The liquid crystal apparatus of the invention was used as a transmission type liquid crystal light bulb. The projector shown in FIG. 18 uses, for example, a three-plate prism type optical system.

In the projector 1100 shown in FIG. 18, a light beam projected from a lamp unit 1102 which is a white light source is divided into three primary colors: red (R), green (G) and blue (B), by a plurality of mirrors 1106 and two dynamic mirrors 1108 in a light guide 1104, and directed into three liquid crystal panels 111OR, 111OG and 1110B displaying respective color images. The light beams modulated by the respective liquid crystal panels 11OR, 111OG and 111OB enter a dichroic prism 1112, red (R) and blue (B) beams are bent by 90°, and only the green (G) beam is allowed to go straight. As a result, images of the individual colors are synthesized and a color image is projected through a projector lens onto a screen or the like.

By mounting the liquid crystal apparatus of the invention as a light bulb on a liquid crystal projector, it is possible to mount a liquid crystal apparatus having a high resolution, and by using the liquid crystal apparatus having such properties as high-speed switching and memory property, there is available a high-precision liquid crystal projector giving a clear image.

The personal computer 1200 shown in FIG. 19 has a main body 1204 provided with a keyboard 1202 and a liquid crystal display screen 1206.

The pager 1300 shown in FIG. 20 has, in a metal frame 1302, a liquid crystal display substrate 1304, a light guide 1306 provided with a back light 1306*a,* a circuit board 1308, first and second shielding plates 1310 and 1312, two elastic conductors 1314 and 1316, and a film carrier tape 1318. The two elastic conductors 1314 and 1316 and the film carrier tape 1318 connect the liquid crystal display substrate 1304 and the circuit board 1308.

The liquid crystal display substrate 1304 is formed by sealing a liquid crystal between two transparent substrates 1304*a* and 1304*b,* and the liquid crystal apparatus of the invention shown in the preceding Examples 1 to 10 is mounted thereon.

EXAMPLE 12

In the Example 12, the liquid crystal apparatus described in the preceding Examples 1 to 10 is used as a reflection type liquid crystal apparatus. A configuration in which a reflection type liquid crystal apparatus is mounted on an electric machine will be described below. When using the liquid crystal apparatus of the invention as a reflection type liquid crystal panel, a reflection type liquid crystal apparatus can be built by forming one of the electrodes from an electrode having reflectivity, or forming a reflection layer on the back of one substrate.

Figure 21:
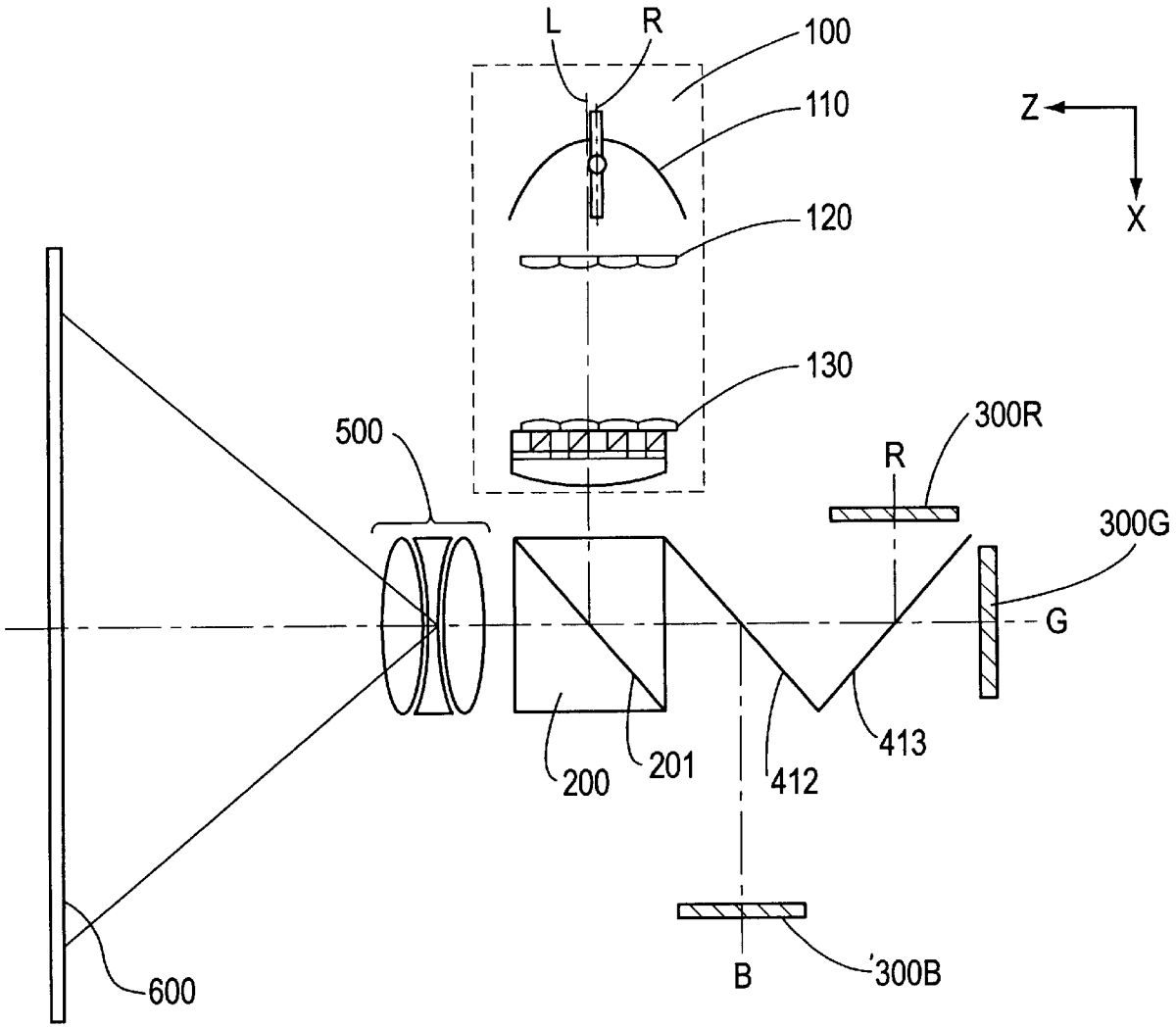
FIG. 21 illustrates a case where the liquid crystal apparatus of the invention is used in the reflection mode and mounted on a projector.

FIG. 21 illustrates an example of an electronic equipment using the liquid crystal apparatus of the invention, and is a schematic plan configuration diagram of a portion of a projector using the reflection type liquid crystal apparatus of the invention as a light bulb.

FIG. 21 is a sectional view on an XZ-plane passing through the center of an optical element 130. The projector of this Example comprises a light source section 110 arranged along a system optical axis L, an integrator lens 120, a polarizing illuminator 100 substantially comprising a polarizing conversion element 130, a polarization beam splitter 200 reflecting an S-polarization flux irradiated from the polarizing illuminator 100 on an S-polarization flux reflector 201, a dichroic mirror 412 which separates a blue (B) component from the light reflected from the S-polarization reflector 201 of the polarization beam splitter 200, a reflection type liquid crystal light bulb 300B modulating the separated blue light beam (B), a dichroic mirror 413 which separates a red (R) component from the light beam after separation of the blue light beam by reflection, a reflection type liquid crystal light bulb 300R modulating the separated red (R) beam, a reflection type liquid crystal light bulb 300G modulating the remaining green (G) light beam which transmits through the dichroic mirror 413, and a projecting optical system 500 which joins the light beams modulated by the three reflection type liquid crystal light bulb 300R, 300G and 300B through the dichroic mirrors 412 and 413 and the polarization beam splitter 200, and comprises a projection lens projecting the joined light onto a screen 600. The liquid crystal apparatus mentioned above are used in the foregoing three reflection type light bulbs 300R, 300G and 300B.

The random polarized light flux irradiated from the light source section 110 is divided into a plurality of intermediate light fluxes through the integrator lens 120, and then converted into a single kind of polarized light flux (S-polarized flux) substantially uniform in the polarization direction by a polarization converting element 130 having a second integrator lens on the light incidence side, thus reaching the polarization beam splitter 200. The S-polarized beam leaving the polarization converting element 130 is reflected by the S-polarized flux reflector 201 of the polarized beam splitter 200, and of the reflected flux, the blue (B) light flux is reflected by a blue beam reflecting layer of the dichroic mirror 412, and modulated by the reflection type liquid crystal light bulb 300B.

From among the light fluxes having passed through the blue beam reflecting layer of the dichroic mirror 411, the red (R) flux is reflected by the red beam reflecting layer of the dichroic mirror 413, and modulated by the reflection type liquid crystal light bulb 300R. On the other hand, the green (G) flux having passed through the red beam reflecting layer of the dichroic mirror 413 is modulated by the reflection type liquid crystal light bulb 300G. The color light beams are thus modulated by the respective reflection type liquid crystal light bulbs 300R, 300G and 300B.

From among the color light beams reflected from the individual picture elements of the liquid crystal apparatuses, the S-polarization component does not transmit through the polarized beam splitter 200 which reflects an S-polarized beam, whereas the P-polarization component passes therethrough. An image is formed by the beams having passed through this polarized beam splitter 200.

Figure 22A:
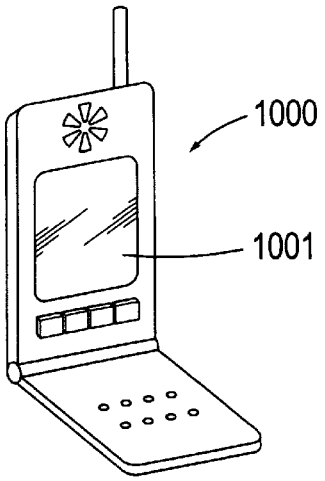
FIG. 22 illustrates liquid crystal apparatus mounted on various electronic machines.
Figure 22B:
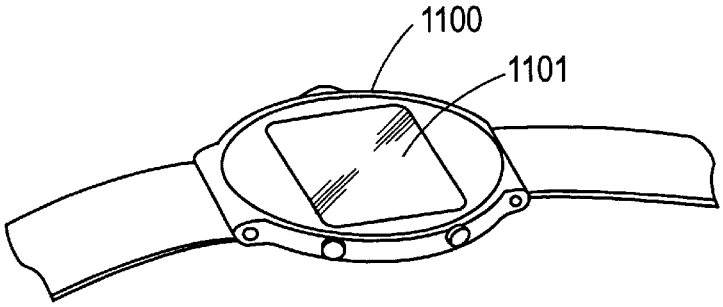
Figure 22C:
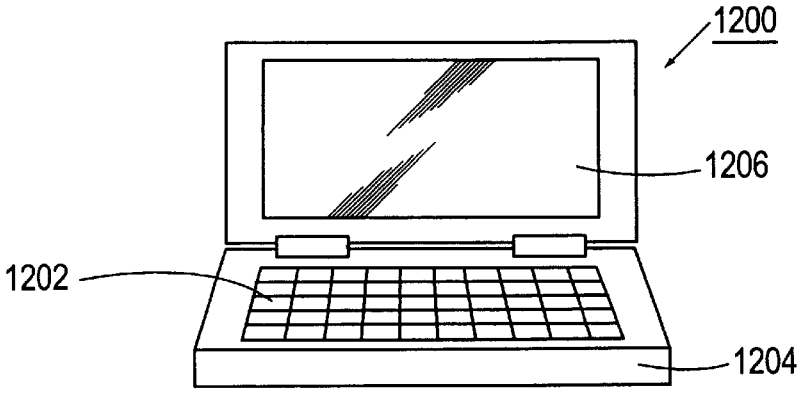

FIG. 22(*a*) is a perspective view illustrating a mobile phone: 1000 is a main body of the mobile phone, and 100 therein is a liquid crystal display section using a reflection type liquid crystal panel of the invention.

FIG. 22(*b*) illustrates a wrist watch type electronic device: 1100 is a perspective view of a watch main body, and 1101 is a liquid crystal display section using the reflection type liquid crystal panel of the invention. This liquid crystal panel, having high-precision picture element as compared with the conventional watch display, can permit a display of a TV image, thus permitting achievement of a wrist watch type TV set.

FIG. 22(*c*) illustrates a portable type information processor such as a wordprocessor or a personal computer: 1200 is an information processor, 1202 is an input unit such as a keyboard, 1206 is a display section using the reflection type liquid crystal panel of the invention, and 1204 is a main body of the information processor. The individual electronic devices are driven by a battery. Therefore, by using a reflection type liquid crystal panel not having a light source, it is possible to extend the device life of the battery. Since peripheral circuits can be built in the panel board, as in the present invention, the number of parts is largely reduced, thus permitting reduction of weight and downsizing.

As is clear from the Examples described above, the liquid crystal apparatus of the invention brings about excellent driving voltage margin and contrast ratio superior to those of the conventional method of scanning line-sequentially for each scanning electrode, by using the driving method in which a plurality of scanning electrodes are simultaneously selected. Particularly, concentric application of selection pulses during the selection period is very effective for expanding the driving voltage margin.

Further, by dividing the selection period into two or more periods, or dispersing the same into a plurality of scanning electrodes and providing variations in the interval time between the selection periods, it is possible to achieve optimization in response to the response property of the individual display elements.

What is claimed is:

1. A driving method of a liquid crystal apparatus comprising a pair of opposed substrates holding a liquid crystal layer therebetween, a plurality of scanning electrodes formed on one of said substrates and a plurality of data signal electrodes formed on another of said substrates, said plurality of scanning electrodes divided into a plurality of groups, each group including a plurality of the scanning electrodes, said liquid crystal layer having at least an initial state in which liquid crystal molecules of said liquid crystal layer have a twisted angle of Φ, a first stable state in which said liquid crystal molecules have an alignment of substantially Φ−180° and a second stable state in which said liquid crystal molecules have an alignment of substantially Φ+180°; the driving method comprising:

(a) within a selected one of said groups, substantially simultaneously applying, a scanning signal to all the plurality of scanning electrodes in the selected group;

(b) within the selected one of said groups, applying, a reset pulse of said scanning signal to all the plurality of scanning electrodes in the selected group substantially simultaneously during a reset period;

(c) within the selected one of said groups, applying a selection pulse of said scanning signal to all the plurality of scanning electrodes in the selected croup substantially simultaneously during a selection period after said reset period, the selection pulses applied to said plurality of scanning electrodes in the selected group have different waveforms from each other;

(d) performing steps (a)–(c) for said plurality of groups sequentially; and (e) within the selected one of said groups, applying a data signal to the plurality of data signal electrodes during the selection period.

2. A driving method of a liquid crystal apparatus according to claim 1, wherein there are 2n (n is an integer of at least 1) scanning electrodes in each of said groups.

3. A driving method of a liquid crystal apparatus according to claim 2, wherein there are four scanning electrodes in each of said groups.

4. A driving method of a liquid crystal apparatus according to claim 1, wherein said selection pulse is set on a basis of an orthogonal function.

5. A driving method of a liquid crystal apparatus according to claim 1, wherein said selection pulse is continuously applied during said selection period.

6. A driving method of a liquid crystal apparatus according to claim 1, wherein said selection pulse is dispersed and applied in said selection period.

7. A driving method of a liquid crystal apparatus according to claim 1, wherein said selection pulse is applied during a period from a start of movement of said liquid crystal molecules from a vertical alignment toward one of said two stable states to a completion of transition.

8. A driving method of a liquid crystal apparatus according to claim 1, wherein a Root Mean Square value of pulse amplitude applied to said liquid crystal layer during said selection period to reproduce one of said stable states is usually equal.

9. A driving method of a liquid crystal apparatus according to claim 1, wherein an interval of time is provided as a delay period between said reset period and a start of said selection period.

10. A driving method of a liquid crystal apparatus according to claim 9, wherein, said interval of time is set to a period of an integer times a minimum selection period.

11. A driving method of a liquid crystal apparatus according to claim 1, wherein each group consists of said plurality of scanning electrodes which are adjacent to each other, and said scanning signal is simultaneously applied to said scanning electrodes in each group.

12. A driving method of a liquid crystal apparatus according to claim 1, wherein each group consists of said plurality of scanning electrodes arranged at random, and said scanning signal is applied simultaneously to said scanning electrodes in said each group.

13. A driving method of a liquid crystal apparatus according to claim 1, wherein said plurality of scanning electrodes formed on one of the substrates are further divided into a plurality of blocks, and said each group consists of said scanning electrodes which are arranged in each block, respectively.

14. A driving method of a liquid crystal apparatus according to claim 1, wherein each group includes at least one virtual scanning electrode in addition to actual scanning electrodes, and said at least one virtual scanning electrode is served as if the scanning signal is applied to it simultaneous with applying the scanning signal to the actual scanning electrodes.

15. A driving method of a liquid crystal apparatus according to claim 14, wherein the voltage levels of said data signal applied to said data signal electrodes are reduced by setting a specified data for the virtual electrode.

16. An electronic equipment mounting a liquid crystal apparatus in a driving method of the liquid crystal apparatus according to claim 1.

17. A driving method of a liquid crystal apparatus according to claim 1, wherein said reset pulses applied to said plurality of scanning electrodes in each group have same waveforms.

18. A driving method of a liquid crystal apparatus according to claim 17, wherein said reset pulses applied to said plurality of groups have same waveforms.

19. A driving method of a liquid crystal apparatus according to claim 1, further comprising applying a same voltage to said scanning electrodes in the selected group during a delay period between said reset period and said selection period, substantially simultaneously.

* * * * *